US012514370B2

(12) United States Patent
Rahman et al.

(10) Patent No.: US 12,514,370 B2
(45) Date of Patent: Jan. 6, 2026

(54) SEATING ARRANGEMENT

(71) Applicant: Steelcase Inc., Grand Rapids, MI (US)

(72) Inventors: Abdul Azim Abdul Rahman, Selangor (MY); Nurzaki Nurikhsan, Selangor (MY); Mohd Hafizi Nor Izham, Selangor (MY); Ahmad Hafizuddin Rosly, Selangor (MY)

(73) Assignee: Steelcase Inc., Grand Rapids, MI (US)

( * ) Notice: Subject to any disclaimer, the term of this patent is extended or adjusted under 35 U.S.C. 154(b) by 211 days.

(21) Appl. No.: 18/367,669

(22) Filed: Sep. 13, 2023

(65) Prior Publication Data

US 2024/0074582 A1 Mar. 7, 2024

Related U.S. Application Data

(63) Continuation of application No. PCT/US2022/020340, filed on Mar. 15, 2022.

(60) Provisional application No. 63/162,356, filed on Mar. 17, 2021.

(51) Int. Cl.
*A47C 1/032* (2006.01)
*A47C 7/44* (2006.01)

(52) U.S. Cl.
CPC ..... *A47C 1/03255* (2013.01); *A47C 1/03274* (2018.08); *A47C 1/03279* (2018.08); *A47C 7/443* (2013.01); *A47C 7/444* (2018.08); *A47C 1/03277* (2013.01)

(58) Field of Classification Search
CPC . A47C 1/03274; A47C 1/03279; A47C 7/443; A47C 7/444
USPC ..... 297/292
See application file for complete search history.

(56) References Cited

U.S. PATENT DOCUMENTS

| | | | |
|---|---|---|---|
| 569,809 | A | 10/1896 | Burke |
| 2,258,783 | A | 10/1941 | McNeal |
| 3,146,592 | A | 9/1964 | Johnson |
| 3,339,973 | A | 9/1967 | Doerner |
| 3,477,761 | A | 11/1969 | Krantz |
| 3,601,444 | A | 8/1971 | Doerner |
| 3,781,060 | A | 12/1973 | Pentzien |
| 4,189,179 | A | 2/1980 | De Graaf |
| 4,305,623 | A | 12/1981 | Seabase |

(Continued)

FOREIGN PATENT DOCUMENTS

| | | |
|---|---|---|
| AU | 720046 | 5/2000 |
| CN | 201308299 Y | 9/2009 |

(Continued)

OTHER PUBLICATIONS

Crandall, David, Adjusting Your Gas Cylinder Set Screw, Nov. 19, 2109, pp. 1-14, Crandall Office Furniture.

(Continued)

*Primary Examiner* — Rodney B White
(74) *Attorney, Agent, or Firm* — Benesch Friedlander Coplan & Aronoff LLP

(57) ABSTRACT

A seating arrangement may include a backrest with a shroud and/or anchor elements securing a membrane and flexible material. An actuator may operate may simultaneously operate boost/stop components acting on a tilt control mechanism of the seating arrangement. An armrest assembly may include a strap, tubular member and adapter interfacing between the strap and tubular member.

18 Claims, 19 Drawing Sheets

(56) References Cited

U.S. PATENT DOCUMENTS 4,373,692 A 2/1983 Knoblauch et al.
4,561,693 A 12/1985 Brownlie et al.
4,779,925 A 10/1988 Heinzel
5,029,940 A * 7/1991 Golynsky ..... A47C 3/026 297/300.4 X
5,213,295 A 5/1993 Scholten et al.
5,282,670 A * 2/1994 Karsten ..... A47C 7/443 297/301.6
5,348,372 A 9/1994 Takamatsu et al.
5,370,445 A 12/1994 Golynsky
5,435,626 A 7/1995 Lai
5,439,267 A 8/1995 Peterson et al.
5,630,647 A 5/1997 Heidmann et al.
5,647,638 A 7/1997 Ritt et al.
5,678,893 A 10/1997 Bock
5,685,609 A 11/1997 Miotto
5,782,536 A 7/1998 Heidmann et al.
5,831,232 A 11/1998 Kushnir et al.
5,909,924 A 6/1999 Roslund, Jr.
5,915,674 A 6/1999 Wolf et al.
5,918,938 A 7/1999 Miotto
5,971,481 A * 10/1999 Emmenegger ..... A47C 1/03279 297/300.4 X
6,059,238 A 5/2000 Reynolds et al.
6,139,107 A 10/2000 Lee
6,254,190 B1 7/2001 Gregory
6,354,662 B1 3/2002 Su
6,394,553 B1 5/2002 McAllister et al.
6,398,309 B1 6/2002 Chen
6,419,323 B1 7/2002 Chu et al.
6,439,661 B1 8/2002 Brauning
6,460,932 B1 10/2002 Kopish et al.
6,540,300 B2 4/2003 Piretti
6,540,950 B1 4/2003 Coffield
6,575,530 B1 6/2003 Fischer et al.
6,585,320 B2 * 7/2003 Holbrook ..... A47C 7/441 297/300.4 X
6,585,322 B1 7/2003 Lai
6,609,755 B2 8/2003 Koepke et al.
6,619,746 B2 9/2003 Roslund, Jr. et al.
6,626,497 B2 9/2003 Nagamitsu et al.
6,692,077 B1 2/2004 Beggs et al.
6,729,691 B2 5/2004 Koepke et al.
6,742,843 B2 6/2004 Golynsky
6,773,072 B2 8/2004 Phillips et al.
6,817,668 B2 11/2004 DeKraker et al.
6,827,406 B2 12/2004 Marini
6,840,582 B2 1/2005 Burwell et al.
6,880,886 B2 * 4/2005 Bodnar ..... A47C 1/03274 297/300.6 X
6,942,300 B2 9/2005 Numa et al.
6,955,402 B2 10/2005 VanDeRiet et al.
6,974,189 B2 12/2005 Machael et al.
6,974,190 B1 12/2005 Hung
7,011,371 B1 3/2006 Tsai
7,029,071 B2 4/2006 Watson et al.
7,147,285 B2 12/2006 Lin
7,156,466 B1 1/2007 Chang
7,165,811 B2 1/2007 Bodnar et al.
7,213,880 B2 5/2007 Schmitz et al.
7,232,234 B2 6/2007 Branham et al.
7,251,917 B2 8/2007 Cvek
7,341,313 B2 3/2008 Bedford et al.
7,347,495 B2 3/2008 Beyer et al.
7,396,081 B2 7/2008 Matern et al.
7,410,216 B2 8/2008 Rutman
7,425,039 B2 9/2008 Lin
7,429,081 B2 * 9/2008 Roslund ..... A47C 1/03279 297/300.4
7,448,687 B2 11/2008 Tsai
7,513,570 B2 * 4/2009 Roslund ..... A47C 1/03266 297/300.4
7,517,024 B2 4/2009 Cvek
7,568,763 B2 8/2009 Bedford et al.
7,611,206 B2 11/2009 Tsai
7,647,714 B2 1/2010 Coffield et al.
7,661,763 B2 2/2010 Tsai
7,717,513 B2 5/2010 Ueda
7,735,923 B2 * 6/2010 Roslund ..... A47C 1/03274 297/300.4
7,748,783 B2 7/2010 Kinoshita et al.
7,775,601 B2 8/2010 Wu
7,819,482 B2 10/2010 Liviero et al.
7,837,265 B2 11/2010 Machael et al.
7,837,272 B2 11/2010 Masunaga et al.
7,841,665 B2 11/2010 Geister et al.
7,857,389 B2 12/2010 Ueda
7,866,750 B2 1/2011 Bock
7,926,879 B2 4/2011 Schmitz et al.
7,946,651 B2 5/2011 Donati
7,997,652 B2 * 8/2011 Roslund ..... A47C 1/03272 297/300.4
8,029,066 B2 10/2011 Su
8,083,288 B1 12/2011 Warncke et al.
8,128,171 B2 3/2012 Tsai
8,172,332 B2 5/2012 Masunaga et al.
8,235,468 B2 8/2012 Fookes et al.
8,246,113 B2 8/2012 Bock
8,251,454 B2 8/2012 Tsukiji et al.
8,297,701 B2 10/2012 Machael et al.
8,388,066 B2 3/2013 Allison et al.
8,616,655 B2 12/2013 Jung
8,777,318 B2 7/2014 Chen
8,857,909 B2 * 10/2014 Bock ..... A47C 3/30 297/302.2
9,155,393 B2 10/2015 Hurford et al.
9,227,541 B2 1/2016 Hosbach et al.
9,521,908 B1 12/2016 Beck et al.
10,194,750 B2 2/2019 Ludwig et al.
10,376,066 B2 8/2019 Su
10,463,153 B2 11/2019 Peterson et al.
10,485,346 B2 11/2019 Jones
10,575,643 B2 3/2020 Wandschneider
10,694,855 B2 6/2020 Zhou et al.
11,307,426 B2 4/2022 Uragami et al.
2001/0002763 A1 6/2001 Roberts et al.
2002/0003368 A1 1/2002 VanDeRiet et al.
2002/0060486 A1 5/2002 Meyer
2003/0178882 A1 9/2003 Schmitz et al.
2004/0017102 A1 1/2004 Igarashi et al.
2004/0095007 A1 5/2004 Wilkerson et al.
2004/0212239 A1 10/2004 Chen
2004/0239170 A1 12/2004 Wang
2005/0274857 A1 12/2005 Gevaert
2006/0198040 A1 9/2006 Branham et al.
2007/0057552 A1 * 3/2007 Roslund ..... A47C 1/03266 297/292
2007/0120410 A1 5/2007 Wiecek
2007/0246988 A1 10/2007 Hung
2007/0262630 A1 11/2007 Sawada et al.
2008/0048480 A1 2/2008 Liviero et al.
2008/0067848 A1 3/2008 Brauning
2008/0203684 A1 8/2008 Berning et al.
2009/0174128 A1 * 7/2009 Donati ..... A47C 1/03272 267/172
2010/0012615 A1 1/2010 Brooks
2010/0038949 A1 2/2010 Liao
2010/0052395 A1 3/2010 Anglese
2010/0264710 A1 10/2010 Lindsay
2011/0068613 A1 3/2011 Breitkreuz et al.
2011/0074197 A1 3/2011 Okamoto
2011/0140498 A1 6/2011 Tsai
2011/0198907 A1 8/2011 Masunaga et al.
2011/0215630 A1 9/2011 Grove
2012/0153694 A1 6/2012 Smith et al.
2012/0161483 A1 6/2012 Hayashi
2012/0200134 A1 8/2012 Lai et al.
2013/0119744 A1 5/2013 Panozzo et al.
2014/0054947 A1 2/2014 Su
2014/0125104 A1 5/2014 Hasegawa et al.
2014/0265460 A1 9/2014 Voigt et al.
2014/0287188 A1 9/2014 Naitou et al.
2015/0289660 A1 10/2015 Su

(56) References Cited

U.S. PATENT DOCUMENTS

| | | | |
|---|---|---|---|
| 2016/0143443 | A1 | 5/2016 | Roslund, Jr. |
| 2017/0099951 | A1 | 4/2017 | Potrykus et al. |
| 2017/0354256 | A1 | 12/2017 | Peterson et al. |
| 2018/0045234 | A1 | 2/2018 | Stauss et al. |
| 2019/0090647 | A1 | 3/2019 | Su |
| 2020/0146452 | A1 | 5/2020 | Chen |

FOREIGN PATENT DOCUMENTS

| | | | |
|---|---|---|---|
| CN | 203493173 | U | 3/2014 |
| CN | 204561515 | U | 8/2015 |
| CN | 105408656 | A | 3/2016 |
| CN | 106104063 | A | 11/2016 |
| CN | 207341498 | U | 5/2018 |
| CN | 208807916 | U | 5/2019 |
| DE | 88 15 010 | U1 | 3/1989 |
| DE | 38 36 398 | A1 | 5/1990 |
| DE | 295 10 446 | U1 | 11/1995 |
| DE | 196 30 839 | A1 | 4/1997 |
| DE | 100 51 817 | A1 | 5/2002 |
| DE | 197 16 720 | B4 | 3/2006 |
| DE | 20 2010 014 557 | U1 | 1/2011 |
| DE | 10 2014 100 380 | B4 | 7/2017 |
| DE | 10 2016 100 547 | A1 | 7/2017 |
| EP | 0 956 792 | A2 | 11/1999 |
| EP | 199 21 153 | A1 | 11/2000 |
| EP | 1 059 051 | A1 | 12/2000 |
| EP | 0 815 777 | B1 | 10/2003 |
| EP | 1 106 110 | B1 | 8/2004 |
| EP | 1 258 211 | B1 | 3/2006 |
| EP | 1 716 785 | B1 | 2/2009 |
| EP | 1 989 961 | B1 | 8/2012 |
| EP | 1 858 372 | B1 | 5/2013 |
| EP | 2 792 276 | A1 | 10/2014 |
| EP | 2 721 963 | B1 | 3/2015 |
| EP | 108236240 | A | 7/2018 |
| FR | 1.427.740 | A | 2/1966 |
| FR | 2 810 596 | B1 | 10/2002 |
| GB | 171548 | | 11/1921 |
| GB | 838665 | | 6/1960 |
| GB | 1 514 188 | | 6/1978 |
| GB | 2 387 776 | A | 10/2003 |
| JP | 3089624 | U | 10/2002 |
| JP | 2004-202062 | A | 7/2004 |
| JP | 2005-110705 | A | 4/2005 |
| JP | 2008-104568 | A | 5/2008 |
| JP | 2008-119251 | | 5/2008 |
| JP | 2008-302062 | A | 12/2008 |
| JP | 4316748 | B2 | 5/2009 |
| JP | 4361783 | B2 | 11/2009 |
| JP | 2010-094456 | A | 4/2010 |
| JP | 4620950 | B2 | 11/2010 |
| JP | 2011-024751 | A | 2/2011 |
| JP | 4964564 | B2 | 7/2012 |
| JP | 2013-103090 | A | 5/2013 |
| JP | 5384807 | B2 | 1/2014 |
| JP | 5479800 | B2 | 4/2014 |
| JP | 5551223 | B2 | 5/2014 |
| JP | 5561634 | B2 | 6/2014 |
| JP | 5562023 | B2 | 6/2014 |
| JP | 5563630 | B2 | 6/2014 |
| JP | 5806087 | B2 | 9/2015 |
| JP | 5855908 | B2 | 12/2015 |
| JP | 2016-036461 | A | 3/2016 |
| JP | 5905707 | B2 | 3/2016 |
| JP | 2017-079897 | A | 5/2017 |
| JP | 2017-079900 | A | 5/2017 |
| JP | 2017-113465 | A | 6/2017 |
| JP | 6271869 | B2 | 1/2018 |
| JP | 2018-068785 | A | 5/2018 |
| JP | 2018-068980 | A | 5/2018 |
| JP | 2018-075110 | A | 5/2018 |
| JP | 2018-183291 | A | 11/2018 |
| JP | 2019-083954 | A | 6/2019 |
| JP | 2019-083957 | A | 6/2019 |
| JP | 2019-084336 | A | 6/2019 |
| JP | 6650094 | B2 | 2/2020 |
| KR | 10-2011-0004982 | | 1/2011 |
| KR | 10-1085018 | B1 | 11/2011 |
| KR | 10-1129229 | B1 | 3/2012 |
| KR | 10-1344936 | B1 | 12/2013 |
| KR | 20-0470578 | Y1 | 12/2013 |
| KR | 10-1446461 | B1 | 10/2014 |
| KR | 10-1576968 | B1 | 12/2015 |
| KR | 10-1976348 | B1 | 5/2019 |
| TW | 1538839 | B | 6/2016 |
| TW | M583714 | U | 9/2019 |
| WO | WO 2004/082435 | A1 | 9/2004 |
| WO | WO 2010/041894 | A2 | 4/2010 |
| WO | WO 2011/021311 | A1 | 2/2011 |
| WO | WO 2014/047242 | A1 | 3/2014 |
| WO | WO 2020/144311 | A1 | 7/2020 |

OTHER PUBLICATIONS

Extended European Search Report issued in European Patent Application No. 22772038.0, dated Feb. 28, 2025.

* cited by examiner

SEATING ARRANGEMENT

This application is a continuation of PCT Application No. PCT/US2022/020340, filed Mar. 15, 2022 and entitled "Seating Arrangement," which application claims the benefit of U.S. Provisional Patent Application No. 63/162,356, filed Mar. 17, 2021 and entitled "Seating Arrangement," the entire disclosures of which are hereby incorporated herein by reference.

FIELD OF THE INVENTION

The present application relates generally to a seating arrangement, for example a seating arrangement having a tilt control mechanism, backrest and/or armrests, and to the methods for the use and assembly.

BACKGROUND

Seating arrangements, such as office chairs, often include a tilt control mechanism for defining the motion and biasing forces of a seat and/or backrest. Often, such seating arrangements include components that move relative to each other and may create pinch points therebetween. In addition, the connections between the components may be complicated, require complex assembly processes and limit the ability to disassemble and/or ship the seating arrangement as separate components. In some embodiments, seating arrangements may also include various biasing and recline limit systems that may be controlled by the user to optimize their seating experience. Such systems, however, often include multiple actuators that may increase the complexity and cost of the system.

Seating arrangements are often provided with an armrest, which may include a tubular support. Such supports may be difficult to secure to a supporting structure due to shape and configuration of the tubular support, or may require an elaborate or aesthetically displeasing support structure to interface with a base or body support member.

Seating arrangements may include a backrest having a frame supporting a flexible material, such as a suspension material. In some embodiments, it may be difficult to secure the suspension material to the backrest in such a way as to properly support the flexible material while also obscuring and protecting the attachment thereof.

SUMMARY

The present invention is defined by the following claims, and nothing in this section should be considered to be a limitation on those claims.

In one aspect, one embodiment of a seating arrangement may include a base, a seat moveably coupled to the base, and a backrest moveably coupled to the base. The seat is moveable between an upright seat position and a reclined seat position. The backrest also is moveable between an upright backrest position and a reclined backrest position. The backrest includes a shroud having a cover portion extending under the seat. The cover portion includes an upwardly facing convex surface disposed under the seat. The shroud is moveable relative to the seat as the seat is moved between the upright and reclined seat positions and the backrest is moved between the upright and reclined backrest positions. In various embodiments, the cover portion may be cantilevered, and may include a free edge.

In another aspect, one embodiment of a backrest assembly includes a backrest support having a laterally extending engagement portion. A backrest frame includes a hook releasably engageable with the engagement portion. The backrest frame is rotatable relative to the backrest support from a disengaged position, wherein the hook is disengaged from the engagement portion, to an engaged position, wherein the hook is engaged with the engagement portion. A fastener releasably connects a shroud, the backrest frame and the backrest support when the backrest frame is rotated to the engaged position.

In another aspect, a method of assembling a seating arrangement includes disposing a hook on a backrest frame adjacent an engagement member on a backrest support, rotating the backrest frame relative to the backrest support from a disengaged positon to an engaged position and thereby engaging the engagement member with the hook, and disposing a base portion of a shroud on the backrest frame. The shroud may include a cantilevered cover portion, defining an upwardly facing convex surface, which extends forwardly from the base portion and terminates in a free edge. The method may further include securing the shroud and backrest frame to the backrest support with a fastener and thereby releasably coupling the backrest frame to the backrest support.

In yet another aspect, one embodiment of a seating arrangement may include a base, a seat moveably coupled to arrange the base, and a backrest moveably coupled to the base. The seat is moveable between an upright seat position and a reclined seat position. The backrest also is moveable between an upright backrest position and a reclined backrest position. A spring is engaged with at least one of the seat or backrest. A spring actuator is rotatable between: (1) a first disengaged position wherein the actuator is disengaged from the spring; (2) an engaged position wherein the actuator engages the spring such that the spring applies a biasing force to the at least one of the seat or backrest as the seat and backrest are moved to the reclined seat and backrest positions respectively; and (3) a second disengaged position wherein the actuator is disengaged from the spring, wherein the first and second disengaged positions of the actuator are different. A stop member is moveably coupled to the actuator, wherein the stop member is translatable, or translatory, between: (1) an engaged position when the actuator is in the first disengaged position, wherein the stop member engages and prevents at least one of the seat and backrest from moving to the reclined seat and backrest positions respectively when the stop member is translated, i.e., moved translatory, to the engaged position; (2) a first disengaged position when the actuator is in the engaged position, wherein the stop member is disengaged from the at least one of the seat and backrest such that the at least one of the seat and backrest may be moved to the reclined seat and backrest positions respectively when the stop member is translated to the first disengaged position; and (3) a second disengaged position when the actuator is in the second disengaged position, wherein the stop member is disengaged from the at least one of the seat and backrest such that the at least one of the seat and backrest may be moved to the reclined seat and backrest positions respectively when the stop member is translated, i.e., moved translatory, to the second disengaged position, wherein the first and second disengaged positions are different.

In another aspect, one embodiment of a seating arrangement may include a base, a seat moveably coupled to the base, and a backrest moveably coupled to the base. The seat is moveable between an upright seat position and a reclined seat position. The backrest also is moveable between an upright backrest position and a reclined backrest position. A spring is engaged with at least one of the seat or backrest. An actuator may include a pinion gear rotatably coupled to the base about a rotation axis and an arm extend radially from the pinion gear. The pinion gear may be rotatable in opposite first and second rotation directions, with the arm engaging the spring as the pinion gear is rotated to a predetermined biasing position. A stop may include a linear rack moveably engaged with the pinion gear, wherein the linear rack is translatable in opposite first and second translation directions in response to the rotation of the pinion gear in the opposite first and second rotation directions. The linear rack includes a stop surface engaging one of the seat or backrest when the linear rack is translated to a predetermined stop position.

In yet another aspect, one embodiment of a seating arrangement may include a base, a body support member coupled to the base, and an armrest assembly. The armrest assembly may include a strap coupled to at least one of the base or the body support member. The strap may have a first end portion. A tubular member may have a second end portion with a first interior opening. An armrest may be supported by the tubular member. An adapter may have a first end with a second interior opening shaped to receive the end portion of the strap and a second end opposite the first end shaped to be received in the first interior opening of the tubular member.

In another aspect, one embodiment of a backrest assembly may include a frame having a pair of laterally spaced uprights and a cross member coupled to and extending laterally between the uprights. A pair of side anchor elements may be coupled respectively to the pair of uprights, with the side anchor elements each having at least one first gripper element extending laterally outwardly. A cross anchor element may be coupled to the cross member and includes at least one second gripper element extending upwardly A membrane may be engaged by the first and second gripper elements, with a flexible material being attached to the membrane and extending between the uprights.

In one embodiment, a pair of corner anchor elements may be disposed between the side anchor elements and the cross anchor element behind a portion of the membrane. In another embodiment, the backrest assembly may include a pair of compressible tensioner elements disposed between a front of the side anchor elements and a rear surface of the flexible material, wherein the tensioner elements impart a tension to the flexible material between the uprights.

The various embodiments of the tilt control system and methods provide significant advantages over other seating arrangements, tilt control systems, backrest assemblies and armrest assemblies and methods for the manufacture and assembly thereof. For example and without limitation, the shroud eliminates various potential pinch points between components moving relative to each other. At the same time, the backrest may be quickly and easily connected to the tilt control mechanism with a quick release system, which reduces assembly time and allows for knock-down shipping. In another embodiment, a single actuator may be used to actuate both a spring boost system as well as a stop system, thereby reducing the number of parts and space occupied by the boost and stop systems. In another aspect, the armrest may be easily and quickly assembled, with the adapter transitioning between the strap and the tubular member. In yet another aspect, the backrest assembly may be quickly and easily assembled, with the membrane being secured to the frame thereby providing a platform for the flexible fabric.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
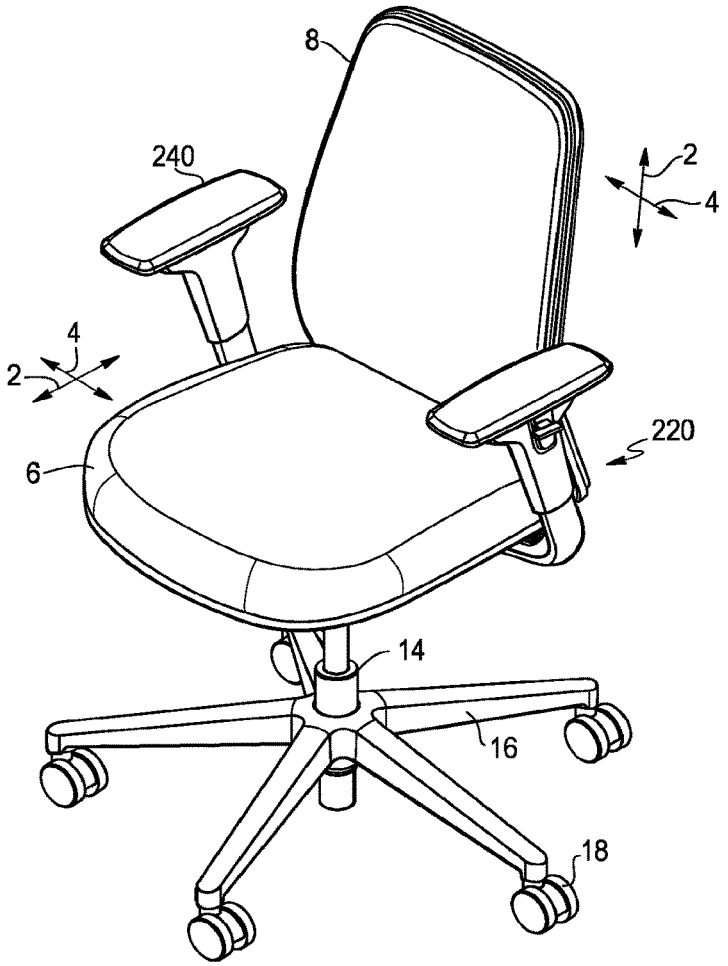
FIG. 1 is a perspective view of one embodiment of a seating arrangement.
Figure 2:
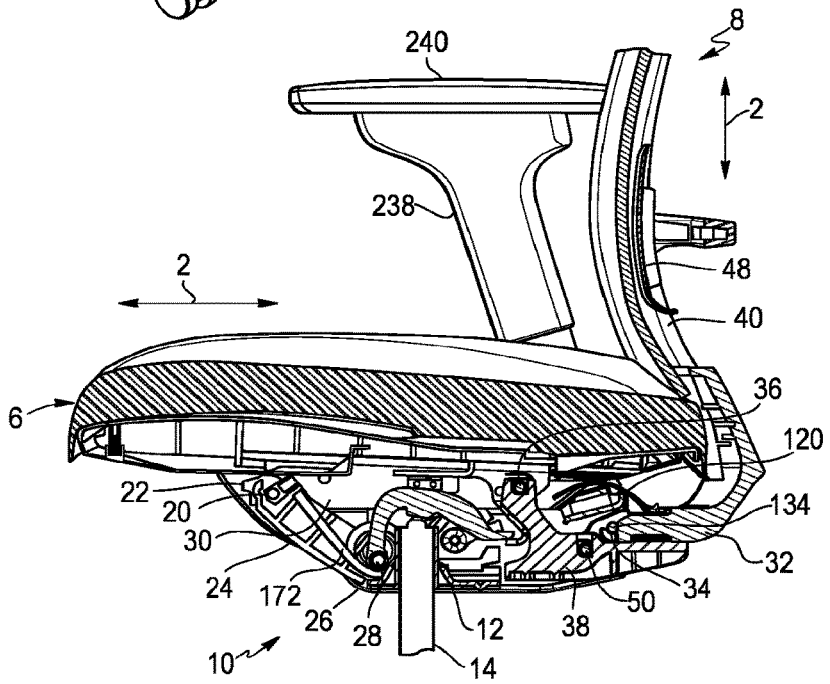
FIG. 2 is a partial cross-sectional side view of the seating arrangement shown in FIG. 1.
Figure 3:
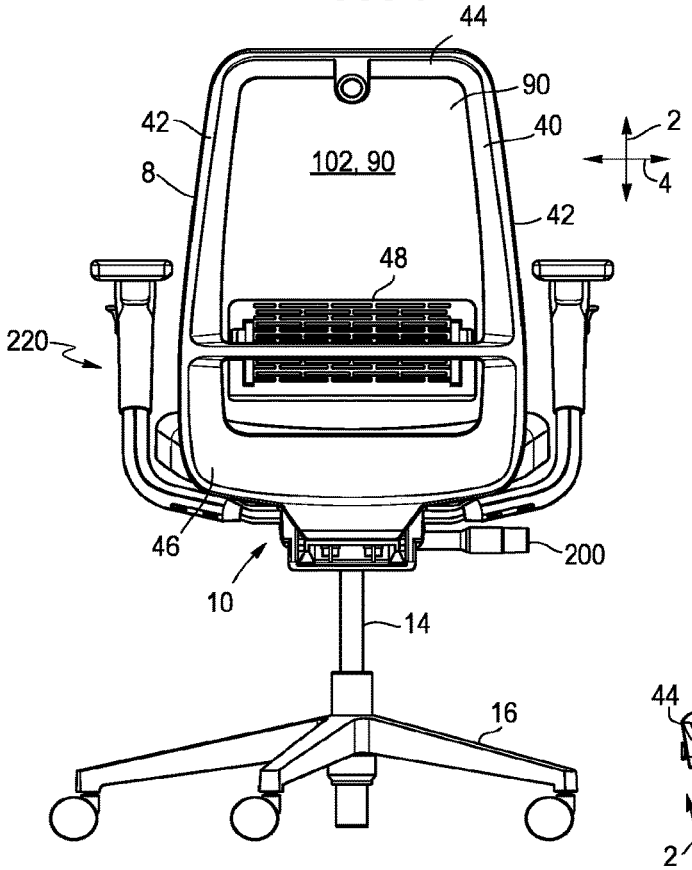
FIG. 3 is a rear view of the seating arrangement shown in FIG. 1.
Figure 4:
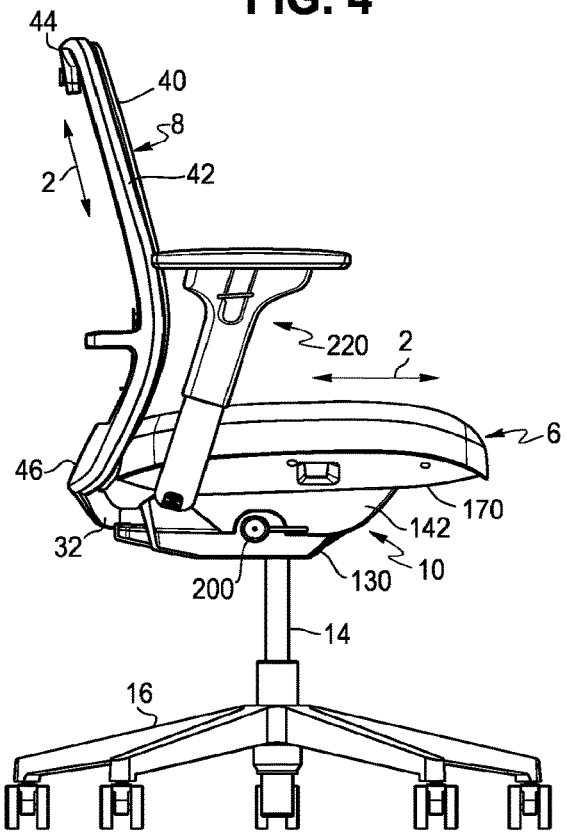
FIG. 4 is a right side view of the seating arrangement shown in FIG. 1.
Figure 5:
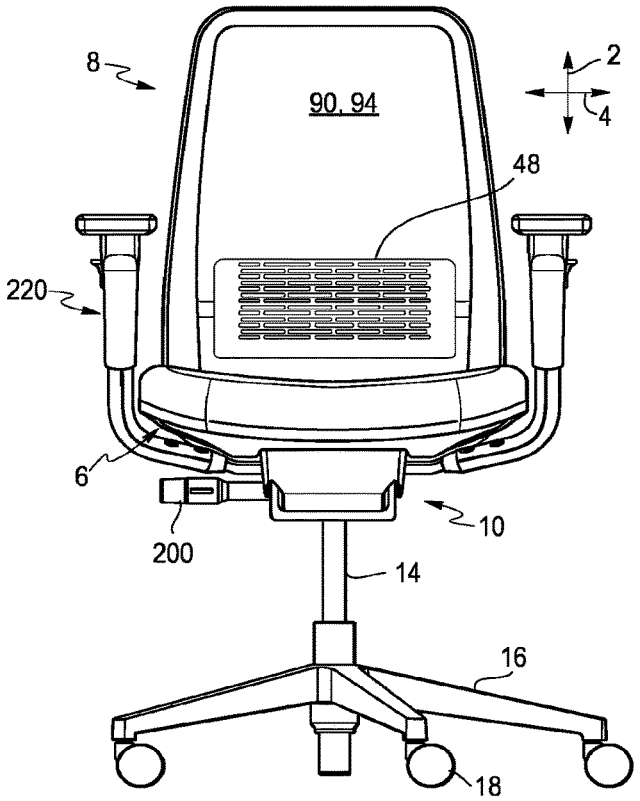
FIG. 5 is a front view of the seating arrangement shown in FIG. 1.
Figure 6:
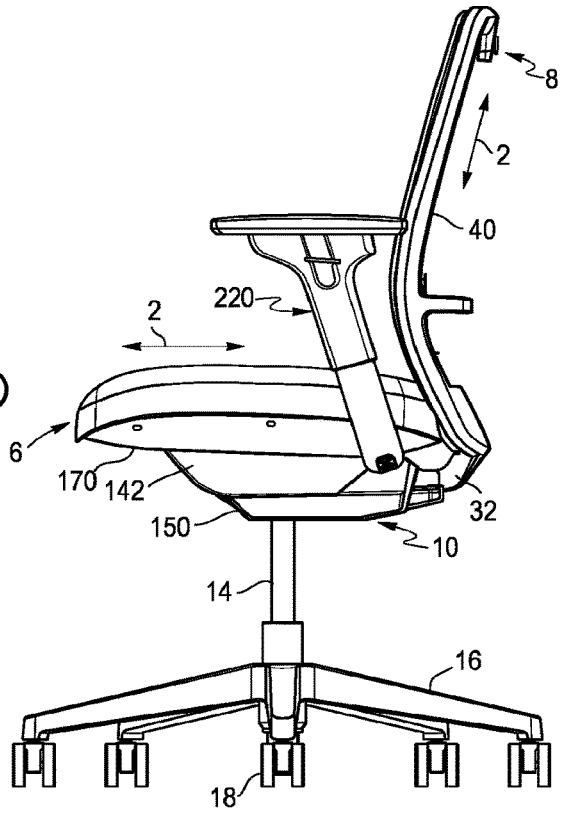
FIG. 6 is a left side view of the seating arrangement shown in FIG. 1.
Figure 7:
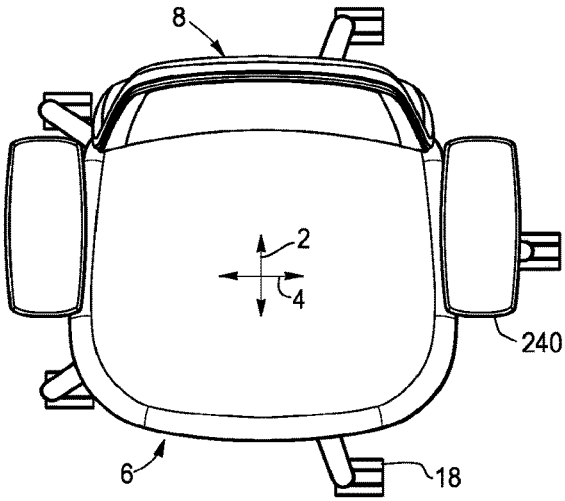
FIG. 7 is a top view of the seating arrangement shown in FIG. 1.

It should be understood that the term "plurality," as used herein, means two or more. As shown in FIGS. 1-7, the term "longitudinal," as used herein, means of or relating to a length or lengthwise direction 2, for example a direction running from a top to bottom of a backrest assembly 8, or a front to back of a seat 6, and vice versa (bottom to top and back to front), or along the length of a component, for example an armrest. The term "lateral," as used herein, means situated on, directed toward or running in a side-to-side direction 4 of the backrest assembly or seat, for example between a pair of uprights 42. The term "coupled" means connected to or engaged with whether directly or indirectly, for example with an intervening member, and does not require the engagement to be fixed or permanent, although it may be fixed or permanent. The term "fixed" means not moveable. The terms "first," "second," and so on, as used herein, are not meant to be assigned to a particular component or feature so designated, but rather are simply referring to such components and features in the numerical order as addressed, meaning that a component or feature designated as "first" may later be a "second" such component or feature, depending on the order in which it is referred. It should also be understood that designation of "first" and "second" does not necessarily mean that the two components, features or values so designated are different, meaning for example a first direction may be the same as a second direction, with each simply being applicable to different components or features. The terms "upper," "lower," "rear," "front," "fore," "aft," "vertical," "horizontal," and variations or derivatives thereof, refer to the orientations of the exemplary seating arrangement as shown in FIGS. 1-7 from the perspective of a user sitting thereon. The phrase "seating arrangement" refers to a structure that supports a body, including without limitation office furniture, home furniture, outdoor furniture and vehicular seating, including automotive, airline, marine and passenger train seating, and may include without limitation beds, office chairs, sofas, stools, and other pieces of furniture or types of seating structures.

Referring to FIGS. 1-15, a seating arrangement includes the seat 6 and backrest assembly 8, which are supported by a tilt control mechanism 10 having a base support 12, which may be configured as a tilt control housing. The base support 12 is coupled to and supported by a support column 14, which is supported in turn by a bottom base 16 configured with one or more floor engaging components 18, such as glides, casters or other types of feet. The bottom base may be configured with multiple legs. Alternatively, the base support may be supported by other types of support platforms and legs, including a sled base, fixed legs (e.g., 2 or more), a pedestal support, rocker support or other suitable support platforms.

The seat includes a seat support 30 having a front portion pivotally connected to an upper end 22 of a link 24 at a first pivot axis 20, for example with a pin or axle. It should be understood that a pivot joint may be defined between the link and seat support by way of a flex joint, including for example a living hinge. A lower end 26 of the link is pivotally connected to the base support at a pivot axis 28, for example with a pin or other type of pivot joint. In other embodiments, the one or both of the pivot axes 20, 28 may also slide relative to the seat support 30. A seat cushion is slidably supported by the seat support 30, such that the depth of the seat 6 may be adjusted relative to the backrest assembly 8.

The backrest assembly 8 includes a frame 40 configured with a pair of laterally spaced apart uprights 42. In one embodiment, the frame has a top cross member 44 extending laterally between the uprights 42, a central cross member 47 and a bottom cross member 46 extending laterally between the uprights 42, with the top and bottom cross members 44, 46 being longitudinally spaced. A lumbar 48 may be vertically moveably supported on the uprights 42. The frame 40 has a centrally located support arm 32 that extends forwardly from the bottom cross member 46 of the frame. The support arm 32 has an upwardly opening hook 34 at a forward end thereof. The support arm 32 has a bottom surface 36 that engages and is supported on a platform 52 defined by a support 38, or lower backrest frame, which is pivotally connected to the base support 12 at a pivot axis 50, defined by a pin or axle, although the support 38 may be connected to the base by a flex joint. The support 38 defines a rear link 54 and has an upwardly extending arm pivotally connected to the seat support 30 at a pivot axis 56, defined for example by a pin or axle, although the connection may be defined by flex joint. The base support 12, front link 24, seat support 30 and rear link 54 define a four-bar linkage that defines the reclining motion of the seat support 30 and backrest assembly 8 relative to the base support 12. It should be understood that the tilt control mechanism may be configured with other types of linkages, including for example and without limitation three-bar slide mechanisms. The seating arrangement (FIG. 2) is configured such that the seat 6 is moveable between a reclined position and an upright position, with the backrest assembly 8 also being concurrently movable between a reclined positon and an upright position. In other embodiments, the seat may be moveable between a reclined and upright position as the backrest remains in an upright position, or conversely, the seat may remain in an upright position as the backrest is moveable between a reclined and upright position.

Referring to FIGS. 16 and 23-34, the backrest assembly 8 includes a pair of side anchor elements 60. Each of the side anchor elements is disposed in a forwardly facing inner recess 62, configured as a channel or interior shoulder in various embodiments, defined by each of the uprights 42. The side anchor elements 60 may be coupled respectively to the upright 42, for example with fasteners 64, a snap fit, adhesives and/or combinations thereof. Each side anchor element 60 includes at least one, and may be configured with a plurality (e.g., 2) of, first gripper elements 66 extending laterally outwardly from a base portion of the side anchor element. The gripper elements 66 may be configured as teeth, tabs or other structure defining a cantilevered insert portion. A cross anchor element 68 is disposed in a forwardly facing channel 70 of the cross member 44 and is coupled to the cross member, for example with fasteners 64, a snap fit, adhesives or combinations thereof. The cross anchor element also includes at least one gripper element 72 extending outwardly, e.g., upwardly from a base portion thereof. The cross anchor element may be configured with a plurality of second gripper elements.

Figure 32:
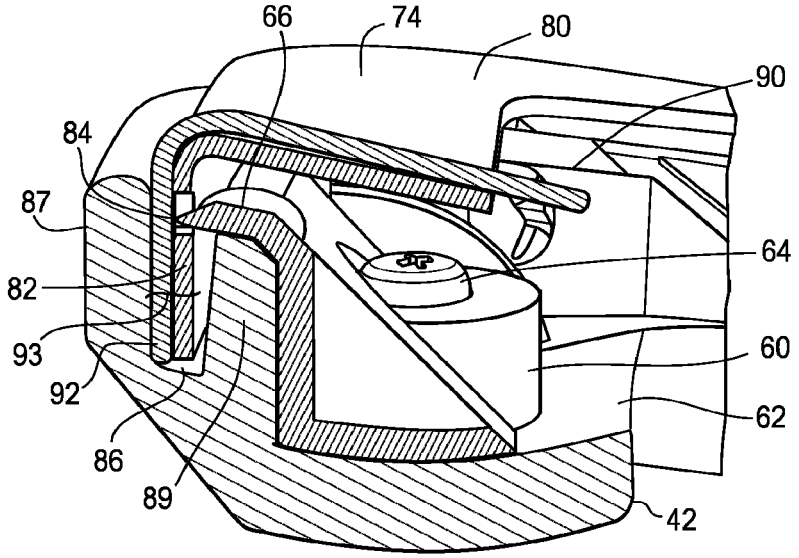
FIG. 32 is a partial, cross-sectional view of the backrest assembly.
Figure 33:
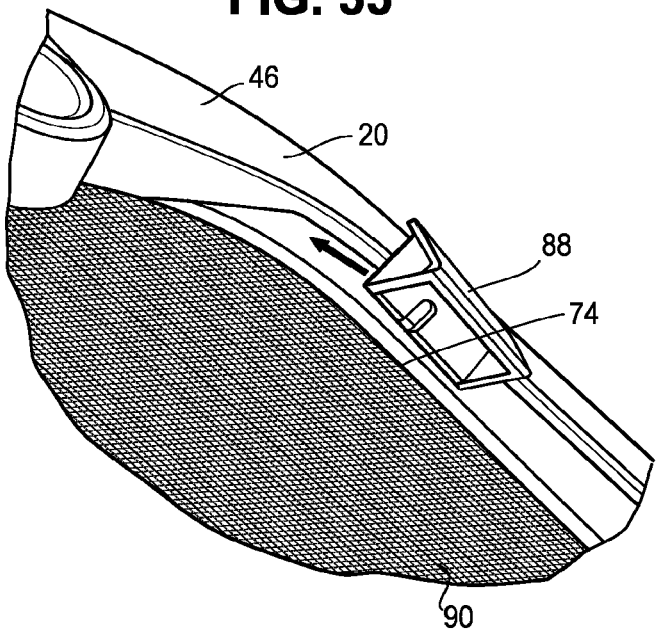
FIG. 33 is a partial rear view showing a corner anchor element in a disengaged position.
Figure 34:
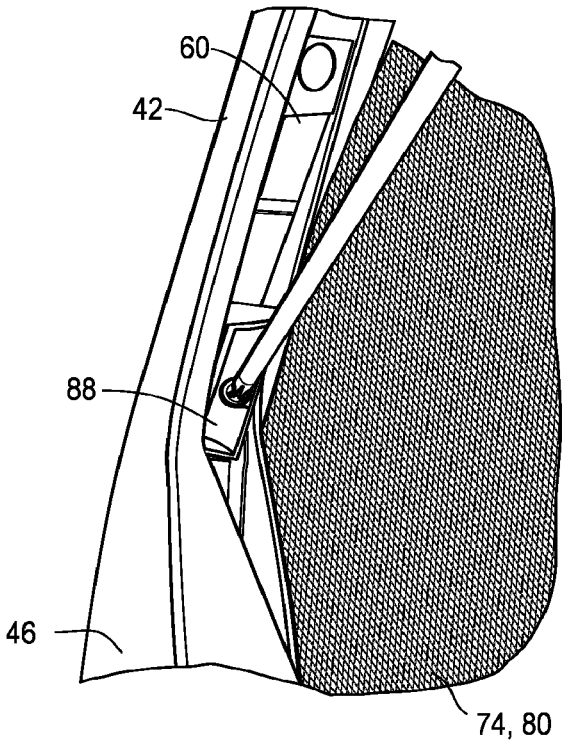
FIG. 34 is a partial rear view showing the corner anchor element being installed in an engaged position.

A membrane 74 is engaged by the first and second gripper elements 66, 72. The membrane may be made, for example, of polypropylene copolymer, or other suitable materials. The membrane 74 may have an overall upside down U-shape, with a pair of laterally spaced side members 76 and a laterally extending cross member 78 joining the side members. The bottom ends of the side members 76 define free ends that are laterally spaced apart. Each of the side members 76 and cross member 78 has a front flange 80 connected to a side flange 82, defining an L-shaped cross-section. The side flanges 82 are engaged by the first and second gripper elements 66, 72 and the front flanges 80 extend inwardly from the side flanges and overlie the side and cross anchor elements 60, 68 respectively. The side flanges 82 may have one or more openings 84 spaced to be aligned with the pluralities of gripper elements 66, 72. The uprights and cross member, including an outermost wall 87 and an inner wall 89 spaced from the outermost wall, may also each define an outer, forwardly facing channel 86. The side flanges 82 of the membrane 74 are disposed in the channels 86 such that the openings 84 are aligned with and engaged by the gripper elements 66, 72, which are inserted into and through the openings 84. The gripper elements 66, 72 may protrude over, or are cantilevered over, the top of the channel 86 as shown in FIG. 32. A pair of corner anchor elements 88 are disposed between the upper ends of respective ones of the side anchor elements 60 and the cross anchor element 68 at the corners of the frame 40. The corner anchor elements 88 are disposed behind the front flange 80 of the membrane, or a corner of the membrane at the junction of side members and cross member. The corner anchor elements 88 may hold the membrane 74 against the frame in the corner thereof, and impart a stretch or tension into a flexible material 90 secured to the membrane. The pair of corner anchor elements 88 may be coupled to the frame 40, for example with fasteners 64 (shown as screws), a friction fit, a snap fit, detent, adhesive, and/or combinations thereof. As shown in FIG. 34, a fastener 64, configured as a screw in one embodiment, is inserted through the corner anchor element 88 into engagement with the frame 40.

A flexible material 90, such as a thin flexible sheet or fabric, e.g. cloth, including woven, non-woven and elastomeric materials, includes an outer perimeter 92 or edge, defined along the sides and top thereof, which is attached to the membrane 74, whether the side or front flange 82, 80, or both, for example by thread, stitching 93, adhesive, or other types of fasteners as shown in FIG. 32. The perimeter 92 is disposed in the channel 86 with the flange 82 of the membrane 74. The flexible material, configured in one embodiment as a mesh or suspension material that may include Nylon or multifilament yarns and elastomeric (e.g., Hytrel) monofilaments, extends across the opening between the uprights 42 and below the upper cross member 46, such that a rear surface of the flexible material is exposed to the user at the rear of the frame. In one embodiment, a front surface of the flexible material also is exposed to the user, with the flexible material configured as a suspension member. In this way, the flexible material 90 has at least three sides secured to the membrane 74, which in turn has three sides secured to the frame 40, such that the flexible material defines the suspension material. The bottom edge of the flexible material 90 is secured to the frame, for example with fasteners such as staples, adhesive, snaps, hooks, other suitable connectors, and/or combinations thereof.

Figure 27:
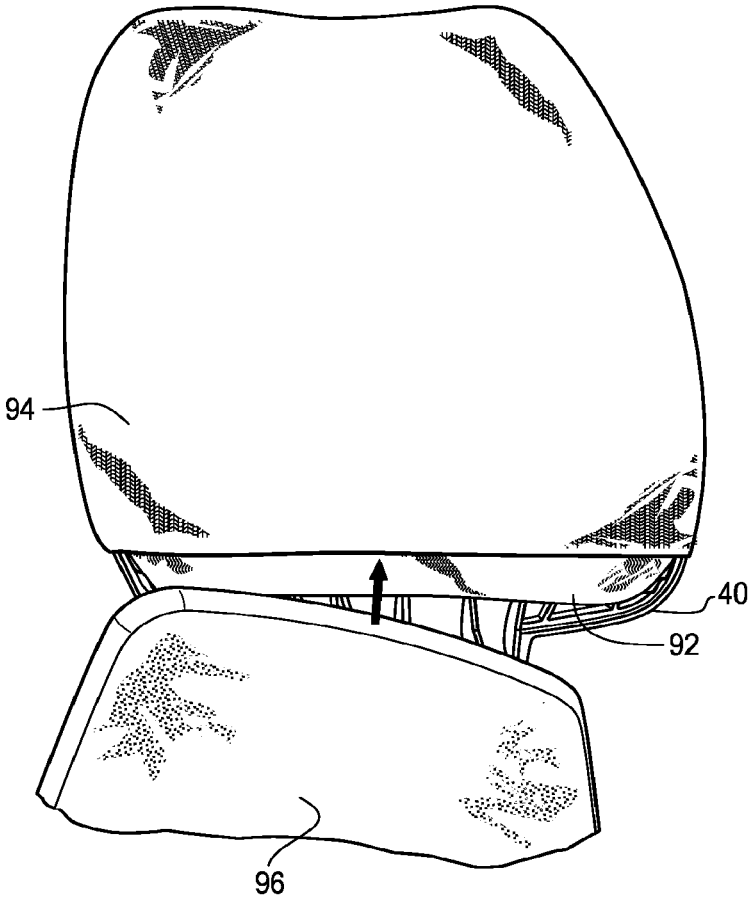
FIG. 27 is a top view showing a cushion being installed between two layers of flexible material.
Figure 28:
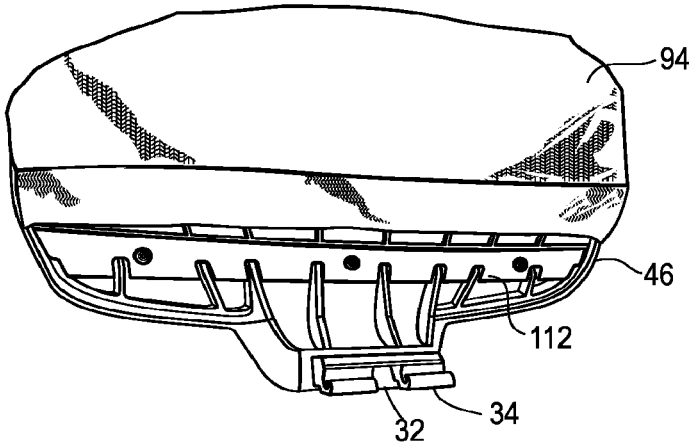
FIG. 28 is a partial bottom view of the backrest assembly showing a stay secured to the flexible material.
Figure 29:
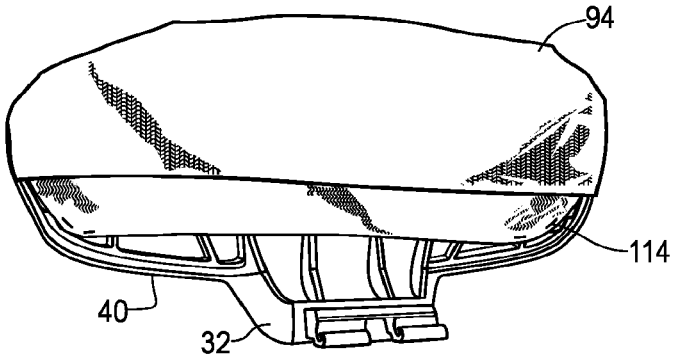
FIG. 29 is a partial bottom view of the backrest assembly showing the stay and flexible material being secured to the frame.
Figure 30:
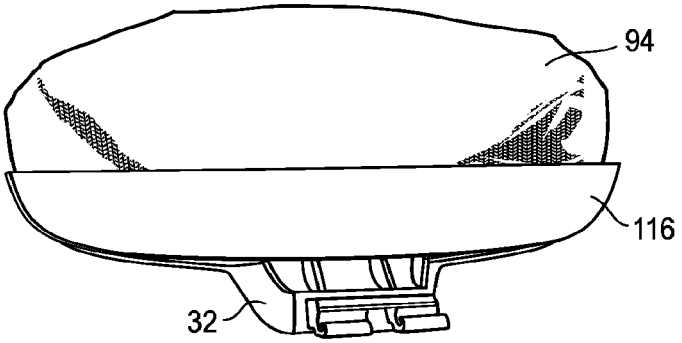
FIG. 30 is a partial bottom view of the backrest assembly showing a cover being secured to the frame.
Figure 31:
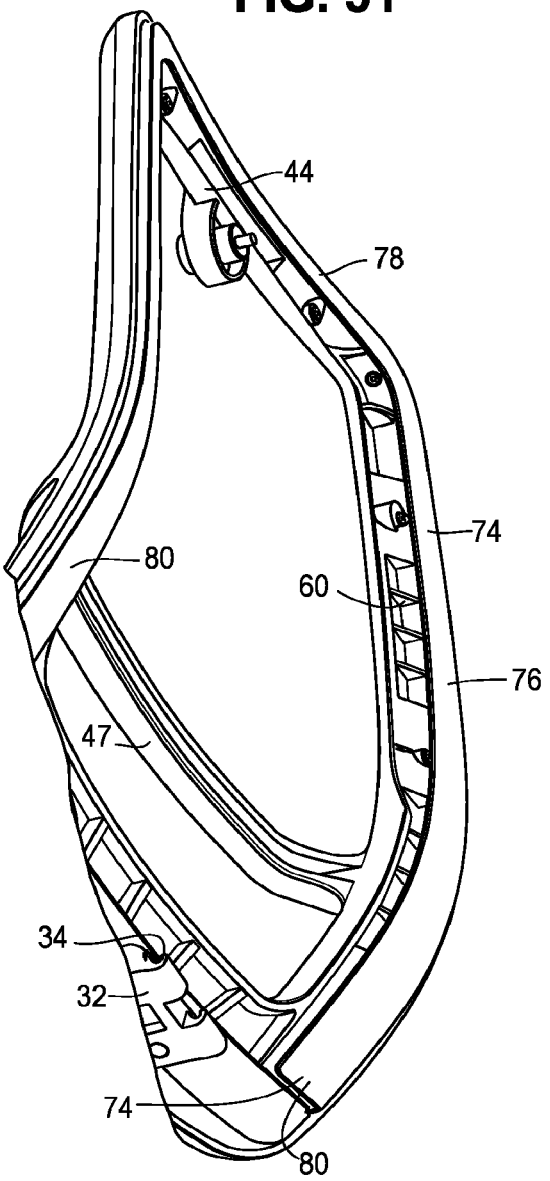
FIG. 31 is a partial perspective view showing a membrane secured to the frame.

In another embodiment, a second flexible material 94 may also is attached to the membrane 74 and first, or rear, flexible material 90, for example by thread, stitching, adhesive, or other types of fasteners, and is disposed in front of the first flexible material 90. The second flexible material may be a thin flexible sheet or fabric, e.g. upholstery or cloth, including woven, non-woven and elastomeric materials. The first and second flexible materials 90, 94, or layers, define a sock enclosed on three sides, but open to the bottom as shown in FIG. 27. A cushion 96 may be inserted from the bottom of the backrest assembly 8 between the layers and disposed between the first and second flexible materials 90, 94. The cushion 96 may be made of a foam material. In this way, the flexible materials 90, 94 are secured to the frame by way of the membrane 74, with the edges thereof disposed in the outer channels 86. It should be understood that, in one embodiment, the second flexible material and cushion may be omitted, with only the single, first flexible material 90 coupled to the frame by way of the membrane, with the first flexible material acting as the suspension member.

Figure 24:
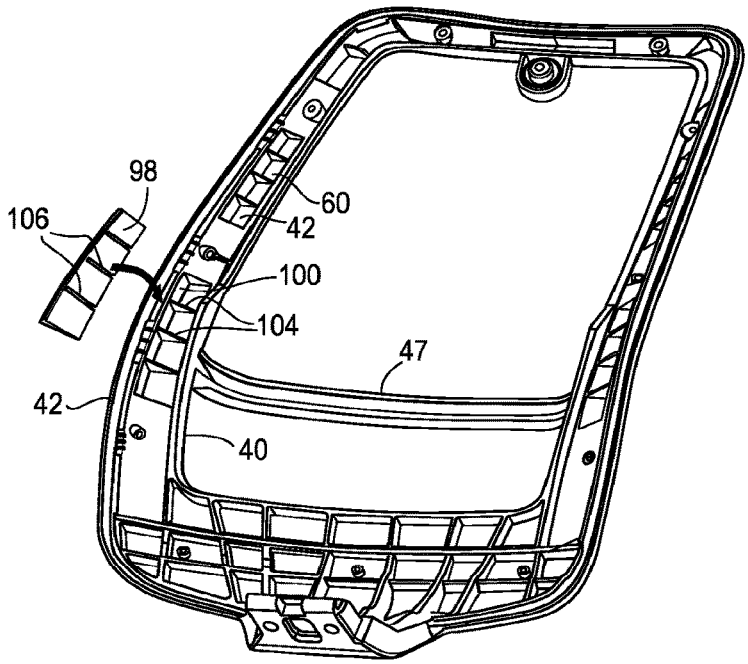
FIG. 24 is a partial, front view of a tensioner element and backrest frame with anchor element.
Figure 25:
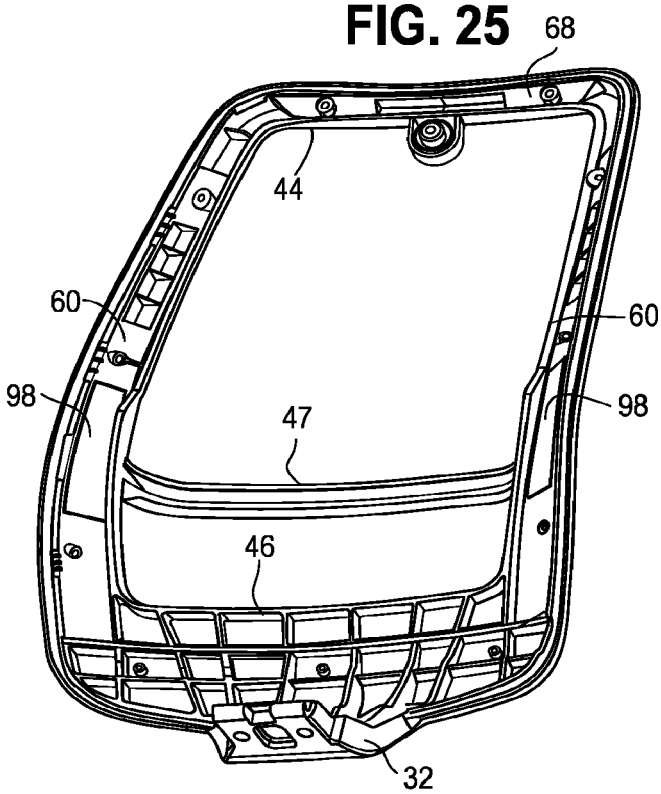
FIG. 25 is a front view of a backrest frame with anchor elements and tensioner elements coupled thereto.
Figure 26:
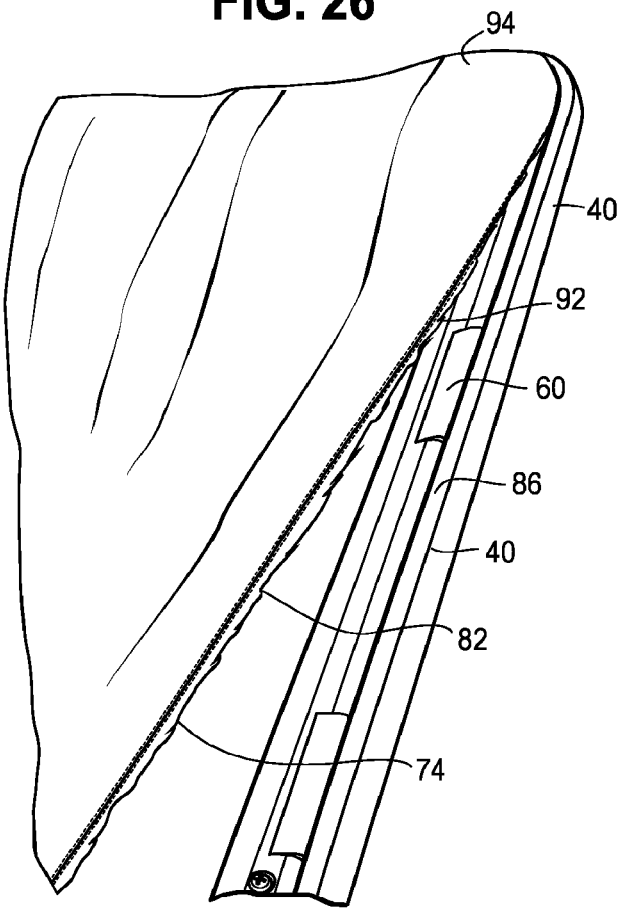
FIG. 26 is a partial front of a backrest assembly showing the assembly of a membrane and flexible material onto the backrest frame and anchor elements.

As shown in FIGS. 24 and 25, a pair of compressible tensioner elements 98 may be disposed between a front surface 100 of the side anchor elements 60 and a rear surface 102 of the flexible material 90. The tensioner elements 98 push against the rear surface 102 of the flexible material and impart a tension to the flexible material laterally between the uprights 42. The tensioner elements 98 may be made of a compressible foam or rubber. In one embodiment, the side anchor elements 60 include a plurality of ribs 104 that are inserted into slots 106 formed in the tensioner elements 98 to locate the tensioner elements vertically along the back frame 40. The ribs/slots may be reversed, with the ribs formed on the tensioner elements and the slots formed in the anchor elements. Alternatively other locaters besides the ribs/slots 104, 106 may be positioned at the interface between the tensioner elements 98 and anchor elements 60. It should be understood that the anchor elements, including the gripper elements, may be integrally formed as part of the back frame, i.e., as a single homogenous unit. The tensioner elements 98 may be positioned at the lumbar region 108 of the backrest assembly, an upper thoracic region 110, both regions, or neither region.

During assembly, the side and cross anchor elements 60, 68 are first attached to the frame 40, as explained above. Tensioner elements 98, as desired, are then inserted or disposed on the anchor elements 60. The membrane 74 and attached flexible materials 90, 94, and in particular the side flanges 82 and edge portions of the flexible materials 90, 94, are inserted into the channel 86, with the gripper elements 66, 72 overhanging the channel and engaging the membrane 74 at the openings where the gripper elements 66, 72 are inserted. The corner anchor elements are then inserted or tucked into the corners, and secured (e.g., with screws) to the frame. Depending on the embodiment, the cushion 96 may then be inserted between the layers. The bottom edges of the flexible materials 90, 94, or the single flexible material 90 in a first embodiment, are attached to the bottom of the frame, or a support platform 112 secured thereto with fasteners, for example staples 114. A cover 116 may be installed, with fasteners, hooks, adhesive, snap-fit, one-way clip fasteners, etc., along a front of the bottom of the frame to cover the bottom edges of the flexible materials 90, 94.

Figure 8:
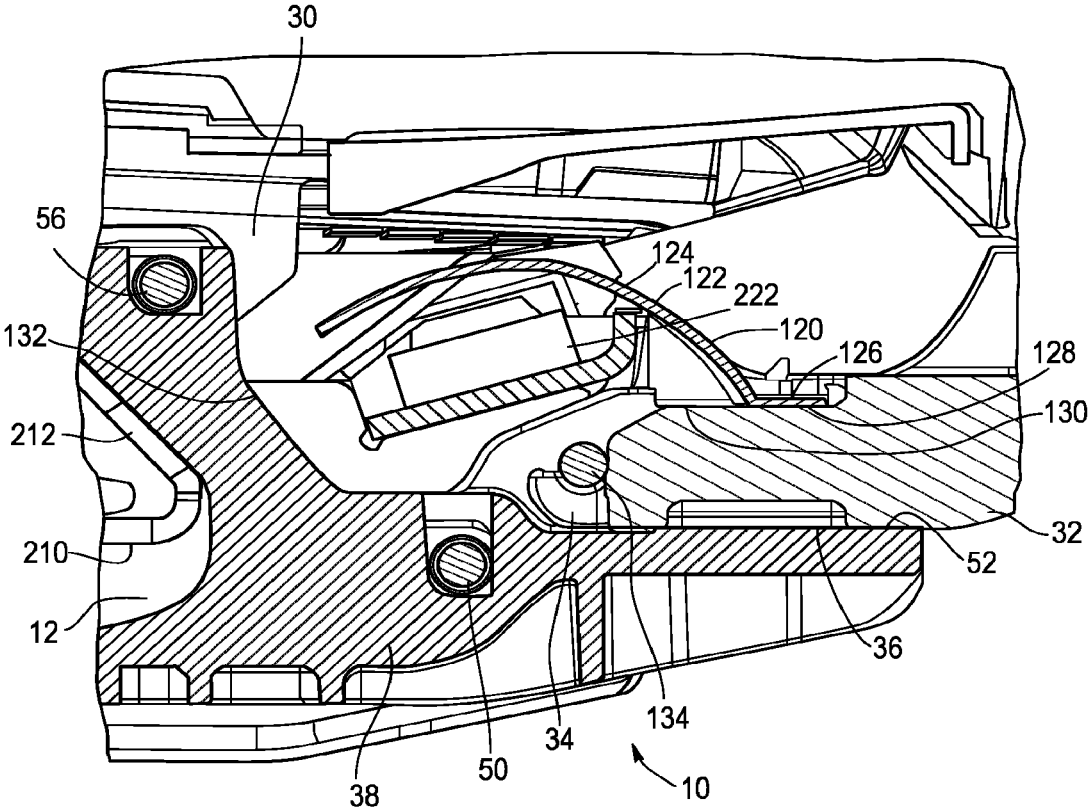
FIG. 8 is an enlarged, partial cross-sectional view of the backrest connection to the base and seat.

Referring to FIGS. 1-15, the backrest includes a shroud 120 having a cover portion 122 extending forwardly under the seat 6. The cover portion has an upwardly facing convex top surface 124 disposed under the seat. It should be understood that the term "convex" means bowed or protruding outwardly/upwardly, such that the surface would define an interior space or volume on the opposite (e.g., bottom) side thereof as shown in FIG. 8, and may include a smoothly defined curved surface such as the exterior of a parabola, cylinder, or may include a curvilinear surface, a plurality of linear surfaces or other curved surfaces. In one embodiment, the surface may be defined as parabolic, while in another embodiment as the exterior of a segment of a cylinder, although it should be understood that any curvature of the surface may not have a single axis of curvature. The shroud 120 is moveable relative to the seat 6 as the seat is moved between the upright and reclined seat positions and the backrest assembly 8 is moved between the upright and reclined backrest positions. It should be understood that the shroud may also be moveable relative to the seat if either of the seat or backrest assembly remains positionally fixed as the other of the seat or backrest assembly is moveable between the upright and reclined positions. The shroud 120 covers and prevents a user from accessing a potential pinch point between the seat 6 and the underlying backrest frame 40 and/or tilt control mechanism 10. The shroud 120 has a base, or mounting, portion 126, positioned at the rear of the shroud, with a bottom surface 128 of the base portion engaging a top platform, or support surface 130 of the backrest support arm 32 behind the hook 34. The cover portion 122 is cantilevered forwardly from the base portion 126 and terminates in a free edge 132, positioned under the seat 6 when the backrest assembly 8 and shroud 120 are installed on the tilt control mechanism 10. The convex top surface 124 is curved in the longitudinal direction, meaning one more axes of curvature of the surface are positioned below the cover and extend laterally. The cover portion 122 may be a thin sheet, made for example of metal or plastic, and is flexible, with the entire cover having a curved shape. The top surface 124 of the cover contacts, or is positioned close to a bottommost surface of the seat 6 to eliminate any pinch points. In one embodiment, the top surface 124 has a contour or profile defined relative to the movement between the seat and backrest assembly, such that the top surface 124 forms a gap with the bottommost surface of the seat, with the gap being less than or equal to 6 mm, and in one embodiment 2-3 mm, during all relative movements between the seat and the backrest assembly. In other words, as at least one of the seat 6 and/or backrest assembly 8 are reclined, the curved surface 124 moves relative to the seat, but maintains contact and/or the maximum spacing in all relative positions of the seat and/or backrest.

Figure 9:
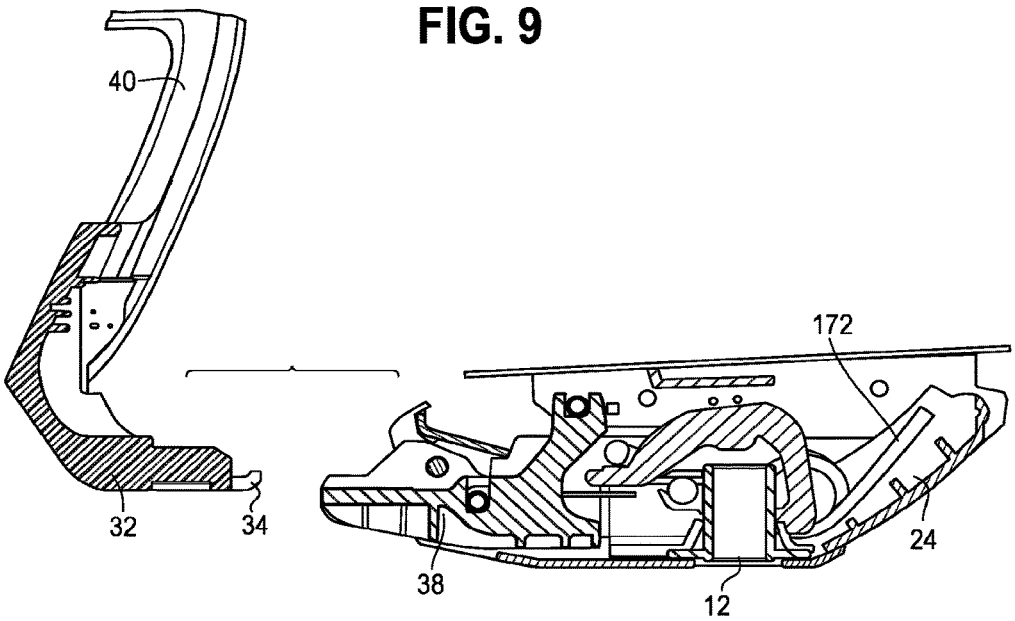
FIG. 9 is side view showing the backrest disengaged from the tilt control mechanism.
Figure 10:
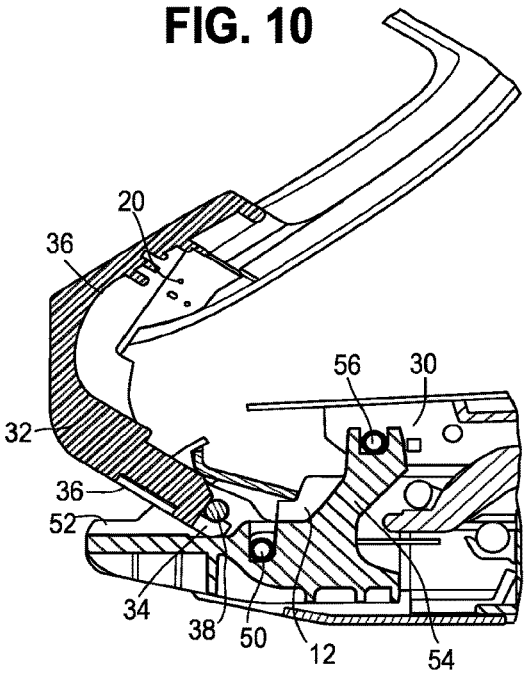
FIG. 10 is a side view showing the backrest being engaged with the tilt control mechanism.
Figure 11:
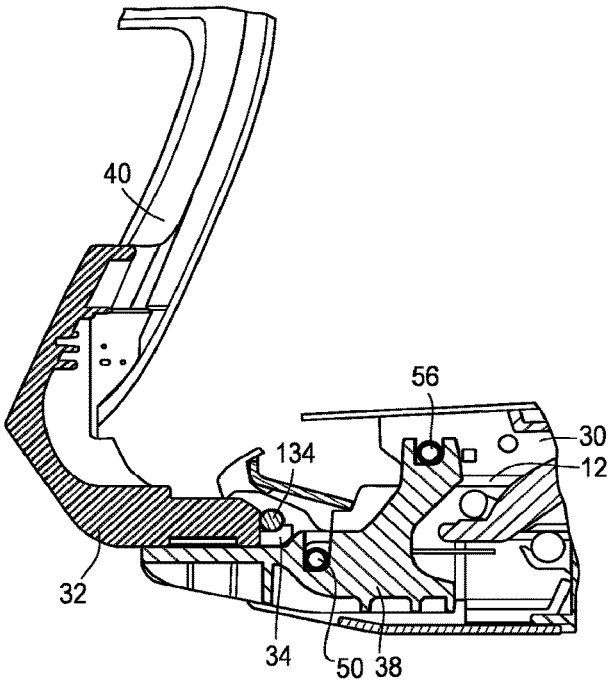
FIG. 11 is a side view of the backrest rotated into an engaged position with tilt control mechanism.
Figure 12:
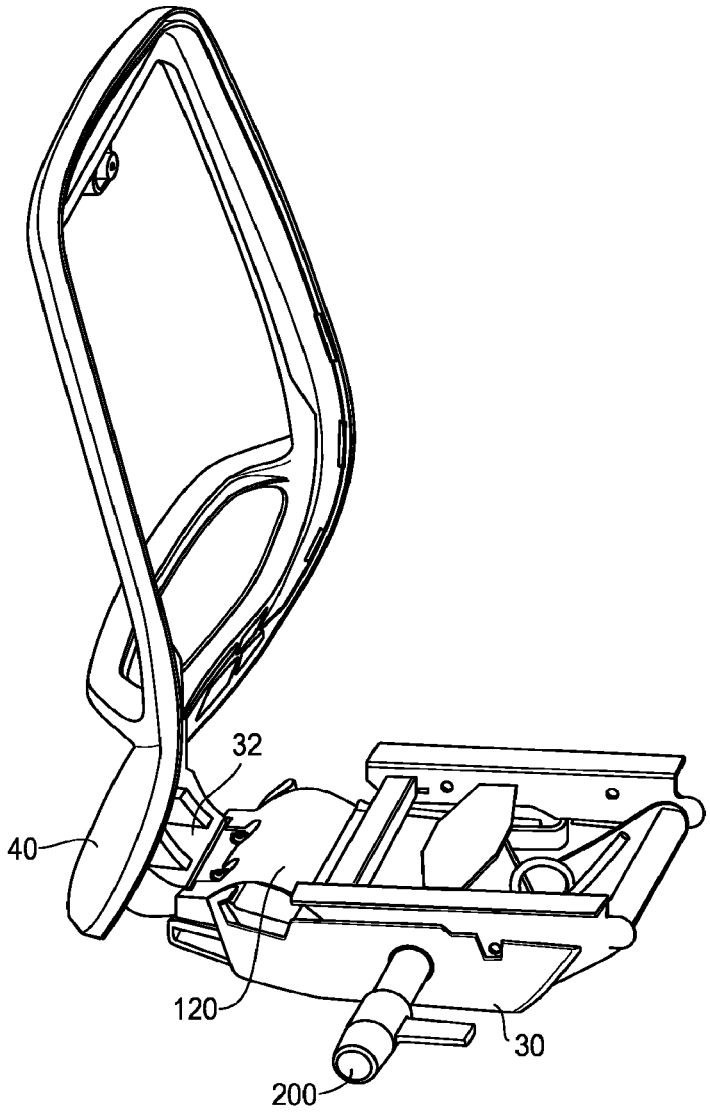
FIG. 12 is a perspective view of the seating arrangement with the backrest in an engaged position.
Figure 13:
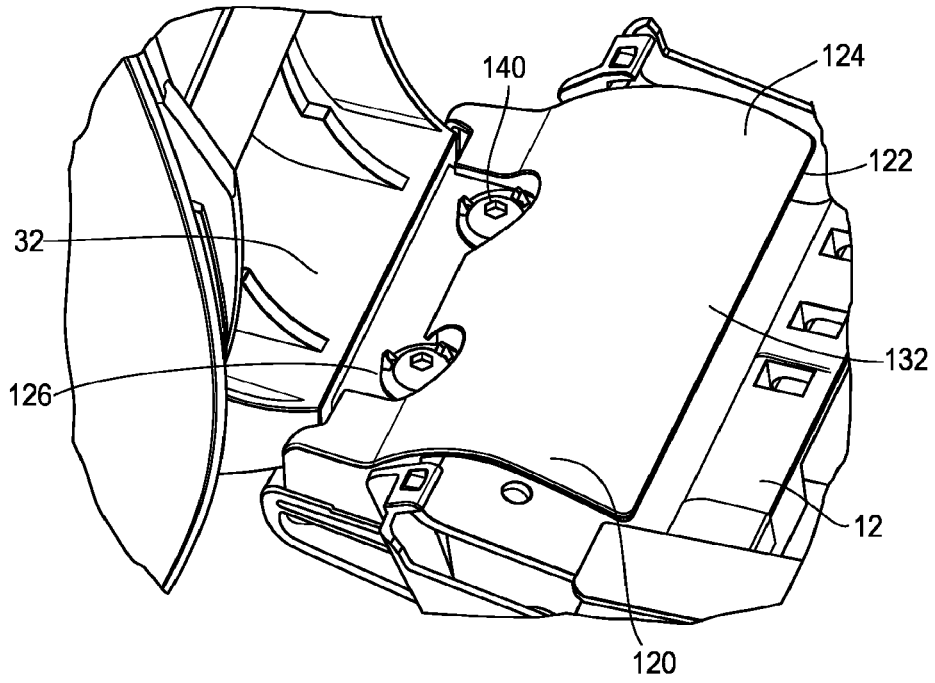
FIG. 13 is an enlarged, partial view showing the shroud and backrest frame secured to the backrest support.
Figure 14:
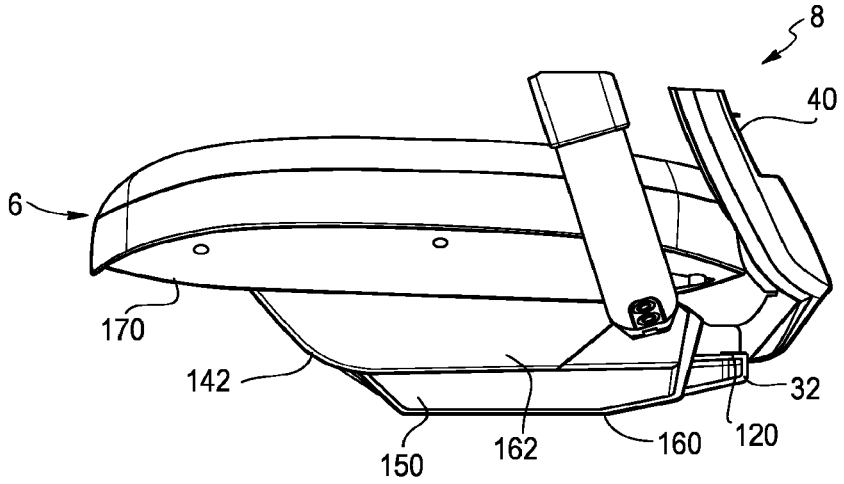
FIG. 14 is a partial side view showing various shrouds enclosing the tilt control mechanism.
Figure 15:
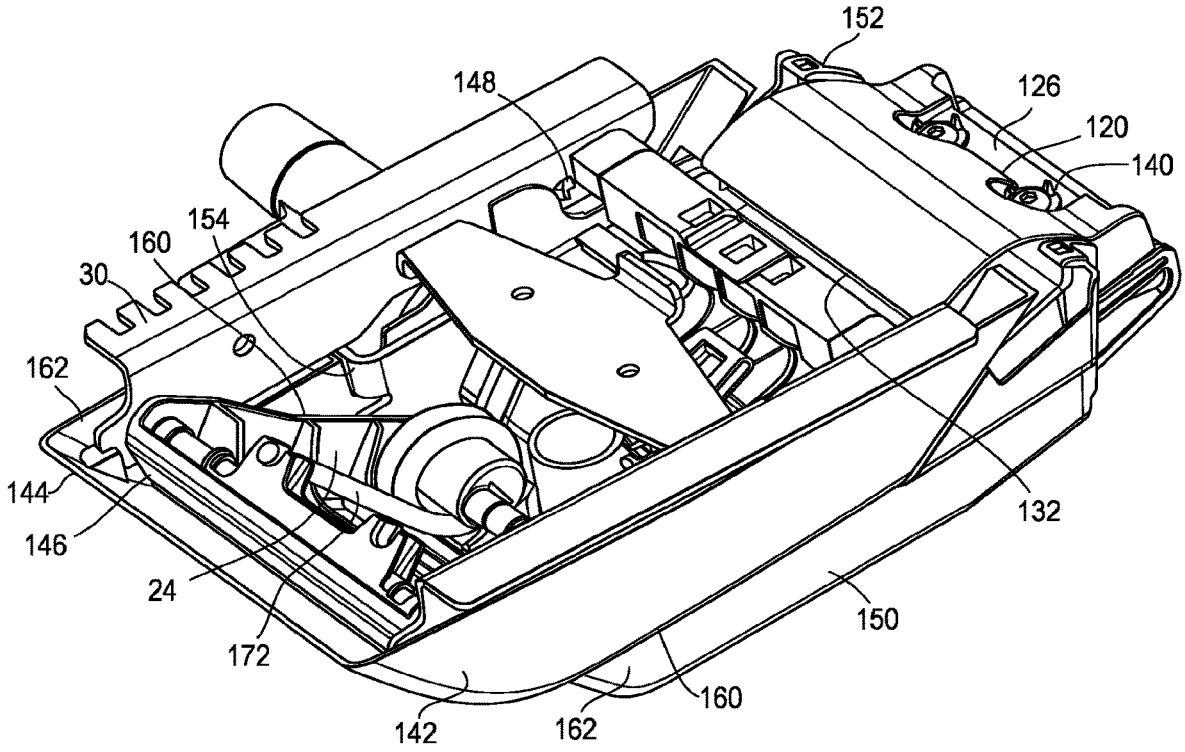
FIG. 15 is a perspective view of one embodiment of a tilt control mechanism.
Figure 16:
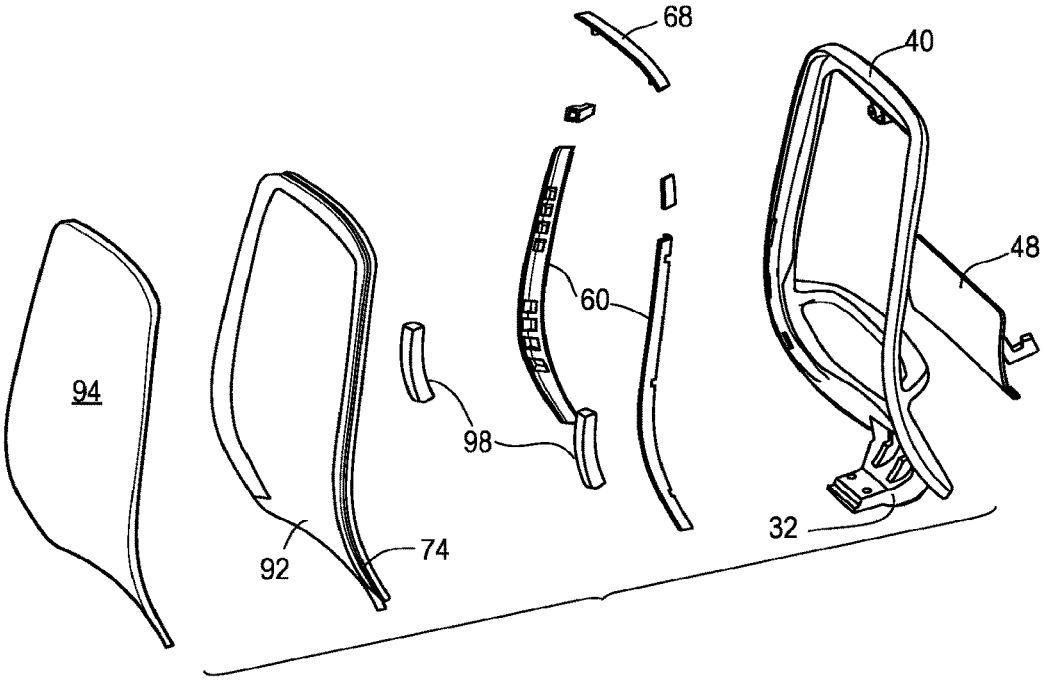
FIG. 16 is an exploded, perspective view of a backrest assembly.
Figure 17:
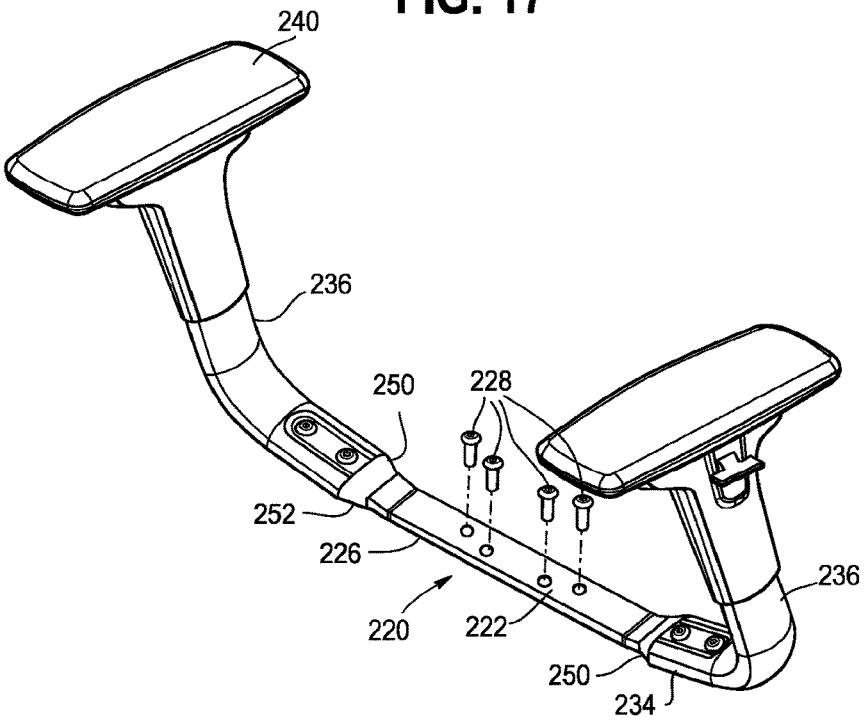
FIG. 17 is a perspective view of an armrest assembly.
Figure 18:
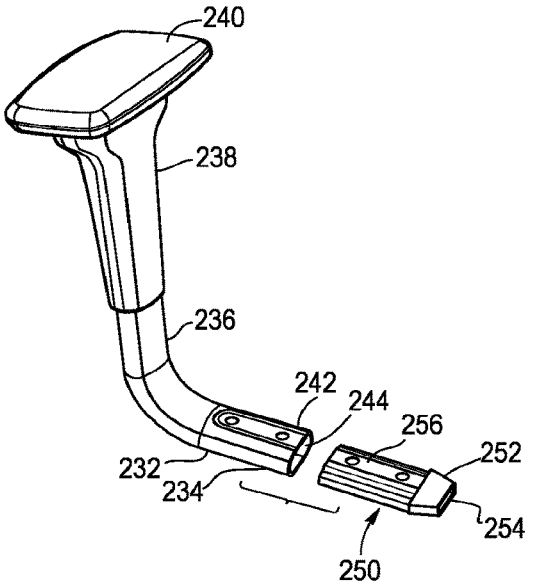
FIG. 18 is an exploded view of an armrest and adapter.
Figure 19:
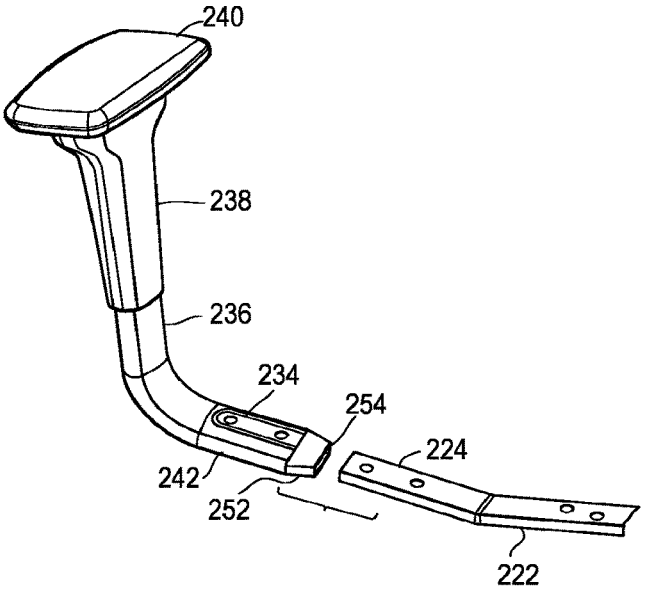
FIG. 19 is an exploded view of an armrest assembly including a strap.
Figure 20:
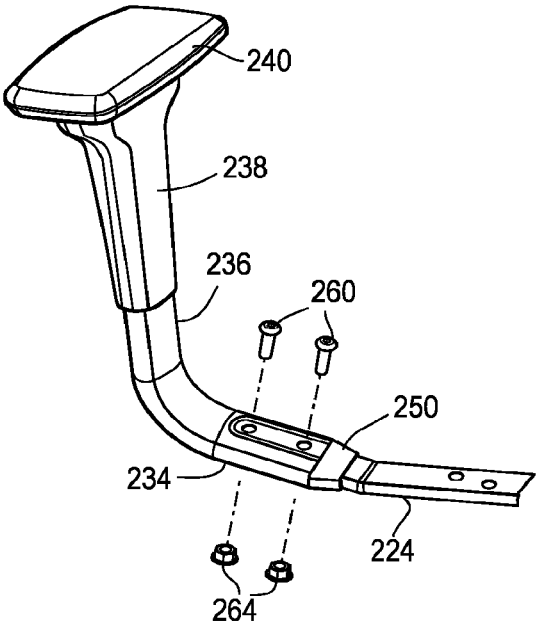
FIG. 20 is a partial perspective view of an armrest assembly with fasteners being installed.
Figure 21:
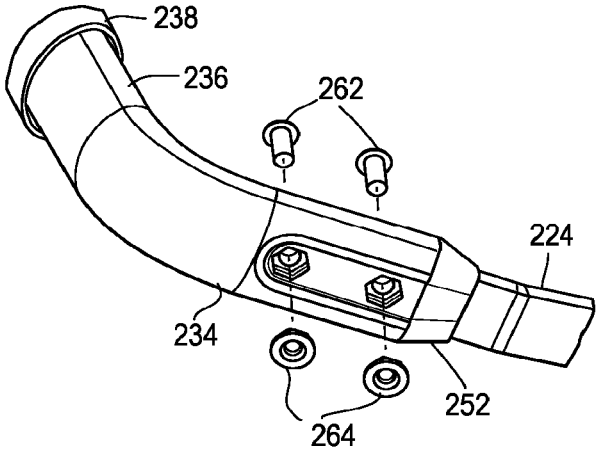
FIG. 21 is a partial bottom view of the armrest assembly shown in FIG. 20.

The backrest frame 40 is releasably coupled to the support 38. In one embodiment, the hook 34 is engageable with an engagement portion 134 on the support. In one embodiment, the engagement portion 134 may be configured as a laterally extending pin or shaft, while in other embodiments, the engagement portion may be a tab, wedge, edge portion or other protuberance. The backrest frame 40 is first moved toward the support 38 as shown in FIG. 9, with the backrest frame 40 then being tilted forward (clockwise when viewed from a right hand side) from a disengaged position as shown in FIG. 10 until the end of the hook 34 may be inserted between the engagement portion 134 and the support platform 52 spaced below the engagement portion. The backrest frame 40 is then rotated rearwardly (counterclockwise when viewed from the right hand side) as shown in FIG. 11 until the bottom surface 36 of the support arm 32 is engaged by and supported on the support platform 52, at which point the hook 34 is engaged with the engagement portion 134 in an engaged position, meaning the backrest assembly cannot be translated forwardly or rearwardly in a longitudinal direction 2 relative to the base support 12. The hook 34 also is prevented from moving vertically up or down by the engagement portion 134. The base portion 126 of the shroud is then disposed on the support arm 32, with the cover portion 122 extending forwardly beneath the seat 6. One or more fasteners 140 may be inserted through the base portion 126 and support arm 32 and threadably engage the support 38, such that the backrest frame 40 is prevented from being rotated out of the engaged position. In this way, the fasteners may serve a two-fold function, including securing the shroud, as well as releasably coupling the backrest frame 40 to the support 38, or tilt control mechanism 10.

Referring to FIGS. 1, 4, 6, 14 and 16, a second shroud 142 may be coupled to the seat support 30, with a first engagement 144 at a front 146 of the seat support and a second engagement 148 along a side of the seat support. The first engagement 144 may include a hook portion, while the second engagement 148 include a snap fit detent, or insert portion that is biased into an opening in the seat support. The shroud is installed by first hooking the first engagement 144 on a front of the seat support and then rotating the shroud under the seat support until the second engagement 148, e.g., the insert portion may be engaged with, e.g., biased into a snap fit with the side of the seat support 30.

A third shroud 150 may be coupled to the tilt control housing, or base, and with a first engagement 152 at a rear of the base and a second engagement 154 along a side of the base. The first engagement may include a hook portion 156 engaging a tab or protuberance 158 on the base support 12, while the second engagement 154 include a snap fit detent, or portion that is biased into engagement with the base support 12. The shroud 150 is installed by first hooking the first engagement 152 on the rear protuberance 158 extending upwardly from the tilt control housing, and then rotating the shroud 150 under the tilt control until the second engagement 154 is biased into a snap fit with the side of the base support 12, otherwise referred to as a tilt control housing. Both of the shrouds 142, 150 have pairs of laterally spaced side walls 160, 162, which overlap and are moveable relative to each other as the seat 6 is moved between the upright and reclined seat positions and the backrest assembly 8 is moved between the upright and reclined backrest positions. In this way, the shrouds 142, 150 protect and enclose the tilt mechanism and eliminate access to any pinch points. In one embodiment, the side walls 160 of the shroud covering the tilt control housing are positioned inboard of the side walls 162 of the shroud covering the seat support 30. The seat 6 may also include a bottom cover 170 that surrounds the shroud 142, and is moveable relative thereto in a longitudinal direction as the depth of the seat 6 is adjusted on and relative to the seat support 30.

The seat 6 and backrest assembly 8 are biased forwardly from the reclined positions to the upright positions by a primary biasing assembly, which includes a primary spring 172. In one embodiment, the spring is configured as a coiled, torsion spring having one arm engaging the pivot axle connecting the front link and seat support at the pivot axis 20 and a second arm engaging the base support or tilt control housing, or other component coupled to the base support 12.

The amount of biasing force may be adjusted by varying the amount of torque applied to the second arm. In alternative embodiments, the primary spring may be configured as one or more of a compression spring, tension spring, and/or leaf spring.

An auxiliary biasing assembly is shown in FIGS. 35A-C and 36. The auxiliary biasing assembly includes an auxiliary spring 180, configured for example as a coiled torsion spring having first and second legs or arms 182, 184. The first arm 182 is engaged with a cross member, e.g., an axle defining for example the pivot axis 20, which in turn is connected to the front link 24 and seat support 30, such that the auxiliary spring, and the arm 182 in particular, is engaged with, or applies a biasing force to, the seat 6. In an alternative embodiment, the auxiliary spring 180 may be positioned such that an arm applies a biasing force to, or is engaged with, the backrest assembly, either directly for example by way of engaging a cross member (e.g., pivot axle), or indirectly, for example by way of the seat support and rear link.

Figure 36:
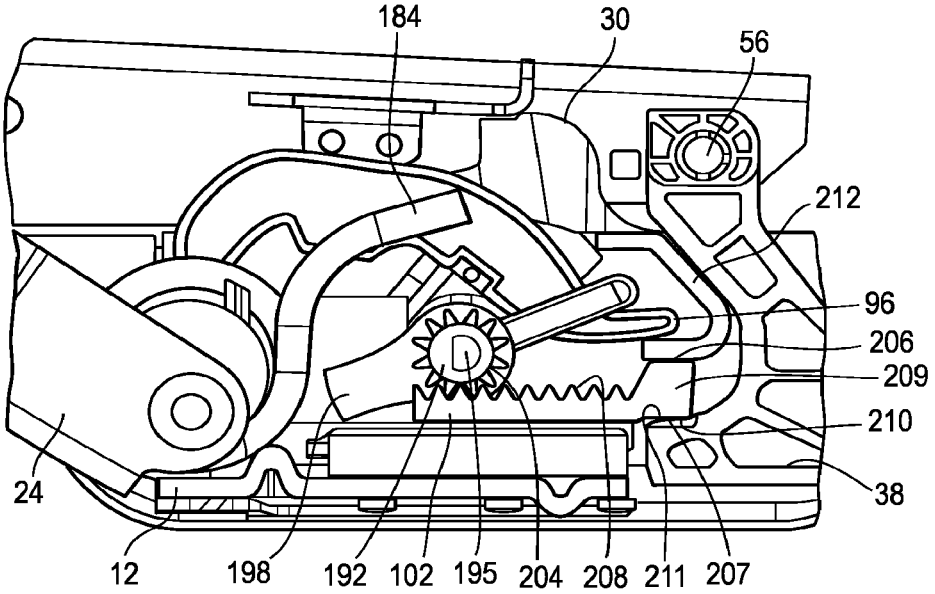
FIG. 36 is a partial side view of the tilt control mechanism with the stop in an upright tilt limit position.

A spring actuator 190 includes a pinion gear 192 that is rotatably connected to the tilt housing about a rotation axis 194, for example by way of an axle 195. The pinion gear has a plurality of circumferentially spaced teeth 196. The actuator includes an arm 198 that extends radially from the rotation axis, meaning it extends outwardly from a central region, even if an axis of the arm does not intersect the rotation axis. The actuator, or pinion gear 192 may be rotated by way of rotation of the axle, or may be rotatable on the axle and may be engaged by another gear or cable, connected to a grippable member 200, causing the pinion gear and arm to rotate. In one embodiment, as shown in FIG. 36, the axle 195 may have a D-shaped key portion that is inserted in and engages a mating D-shaped key hole kin the pinion gear 192, such that the axle 195 is not rotatably fixed to the pinion gear 192.

Figure 35A:
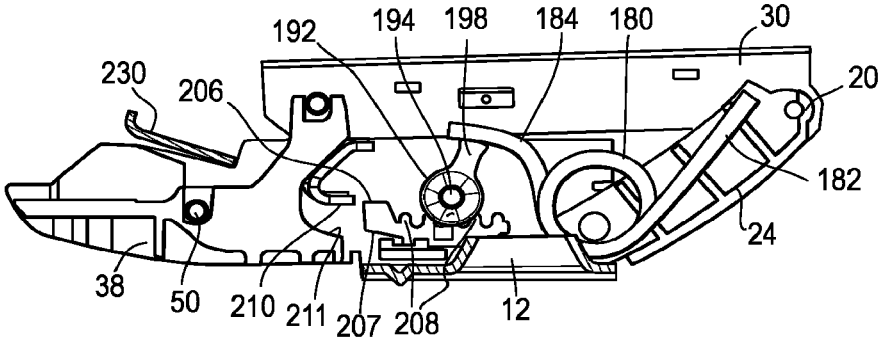
FIGS. 35A-C are side views showing the actuator and stop in a boost position, an upright tilt limit position, and an unboosted position, respectively.
Figure 35B:
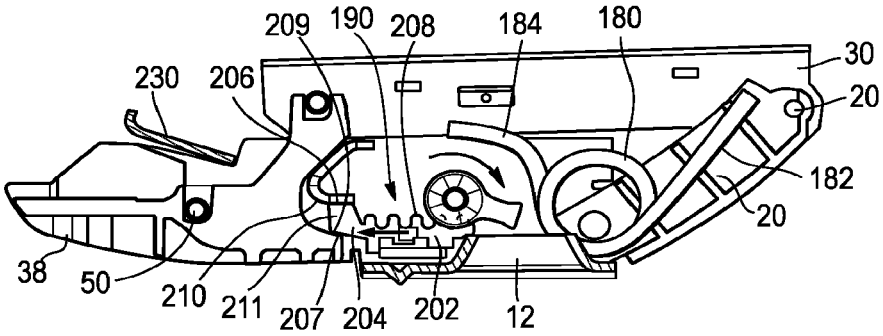

In this way, rotation of the grippable member 200 effects a rotation of the pinion gear 192. The actuator may be moved to rotate the pinion gear in opposite first and second rotation directions. As the pinion gear 192 is moved or rotated, the arm 198 is rotated about the axis 194. The arm is moveable, or rotatable, in a first rotation direction (e.g., counterclockwise) between a first disengaged position wherein the arm 198 is disengaged from the spring, or second leg 184 thereof (FIG. 35B) to an engaged position (FIG. 35A) wherein the arm 198, or an end portion thereof, engages the leg 184 of the spring such that the spring 180 applies a biasing force to the seat 6 and/or backrest assembly through the axle 20 as the seat and backrest assembly are moved to the reclined seat and backrest positions respectively. In this predetermined biasing position, the arm 198 is positioned to exert a counteracting force on the spring 180, allowing it to bias the seat 6 and/or backrest assembly 8 to an upright position. The spring 180 is biased between the arm 198 of the actuator and the axle or cross member defining the pivot 20, such that a return force is applied to the axle as the arm 198 is anchored and supported by the tilt control housing. In this way, the auxiliary boost spring 180 may provide an auxiliary biasing force to the seat 6 and backrest assembly 8. The arm 198 may also be moved, or rotated in the first rotation direction to a second disengaged position (FIG. 35C), wherein the actuator, i.e., arm 198, is again disengaged from the spring 180. It should be understood that the first and second disengaged positions are different, as shown in FIGS. 35B and C, meaning the arm is in a different rotational position even though it is disengaged from the spring 180 in both positions. The actuator, including the pinion gear 192 and arm 198, may also be rotated in the second rotation direction (clockwise) from the second disengaged position (FIG. 35C) to the engaged position (FIG. 35A) to the first disengaged position (FIG. 35B).

Figure 22:
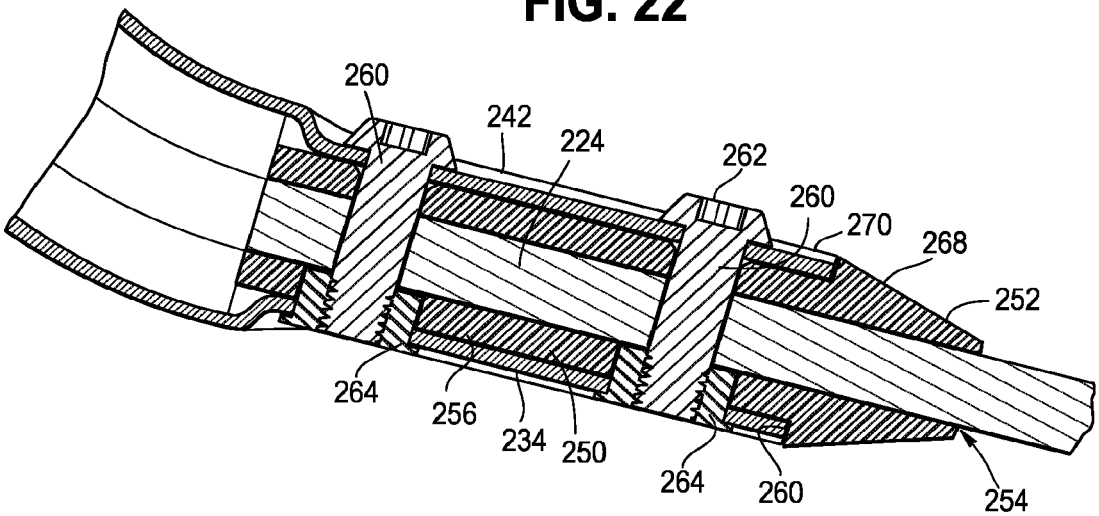
FIG. 22 is a partial cross-sectional view of the armrest assembly.
Figure 23:
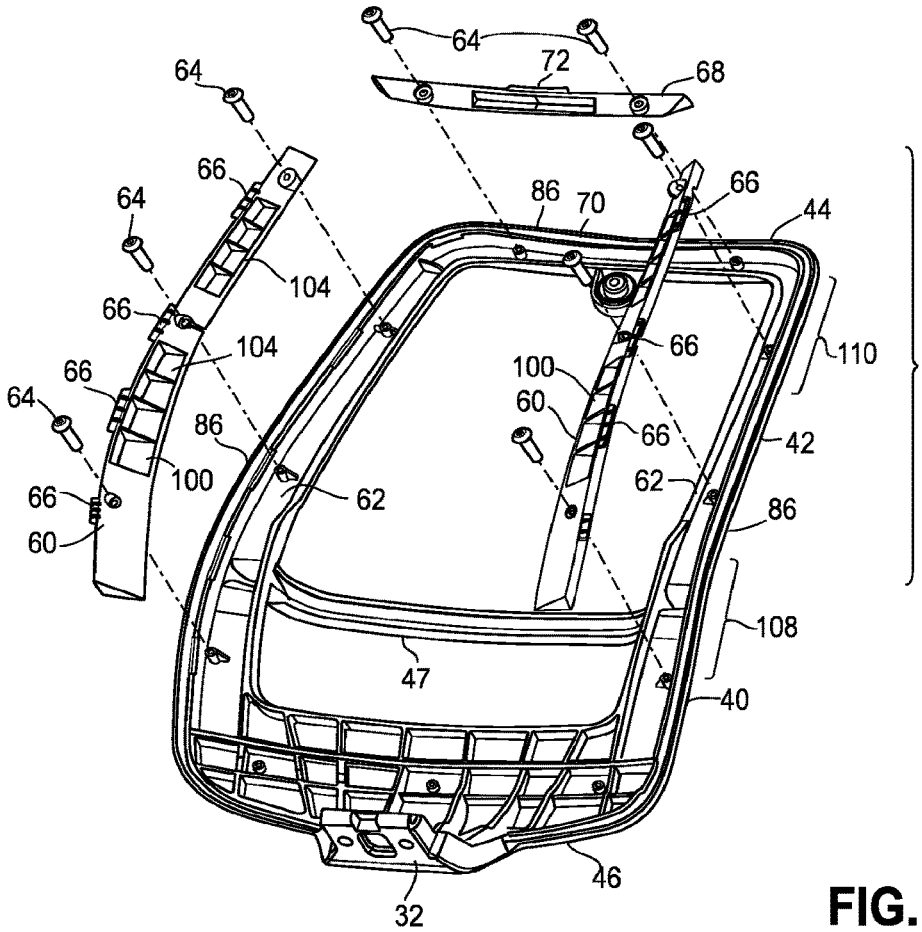
FIG. 23 is a front, exploded perspective view of a backrest frame and anchor elements.
Figure 35C:
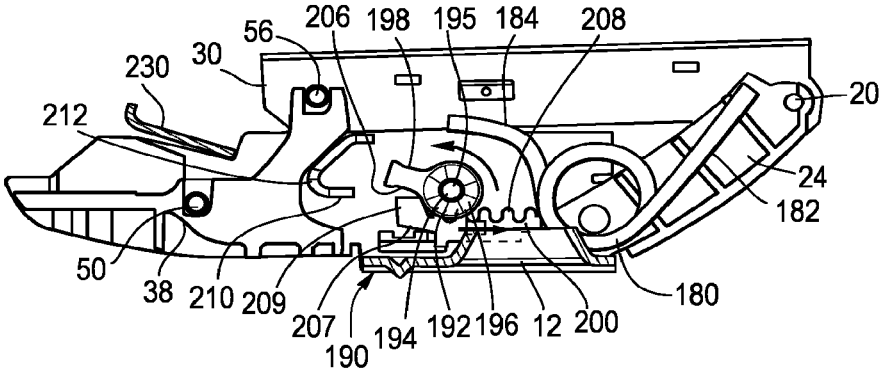
Figure 37:
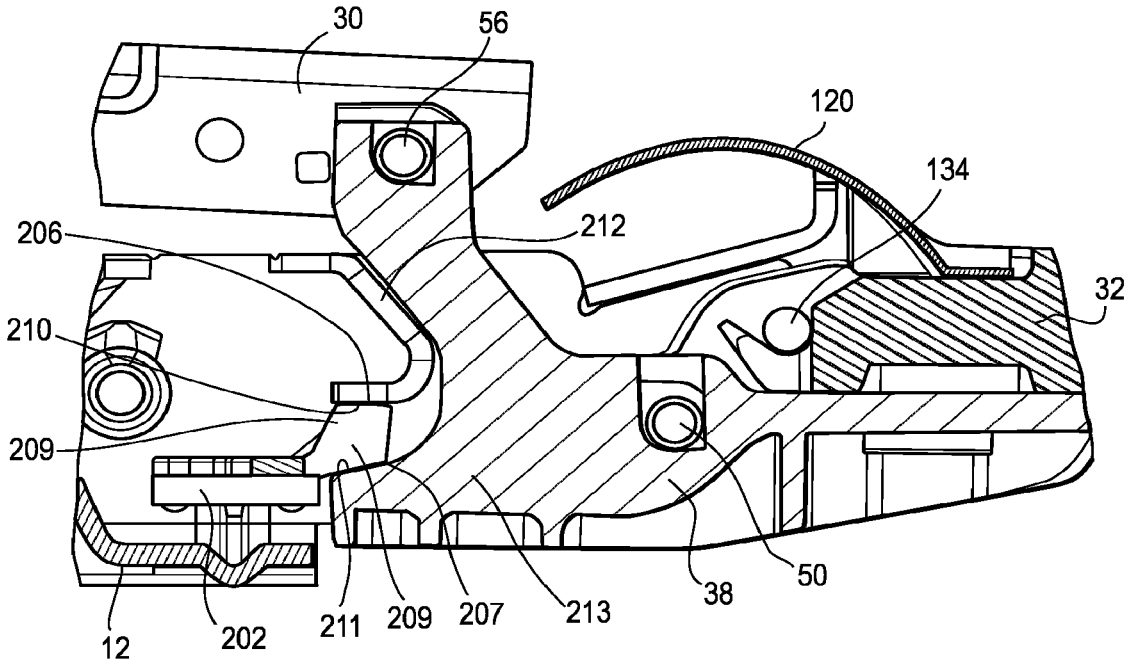
FIG. 37 is a partial side view of the tilt control mechanism with the stop in an upright tilt limit position.
Figure 38:
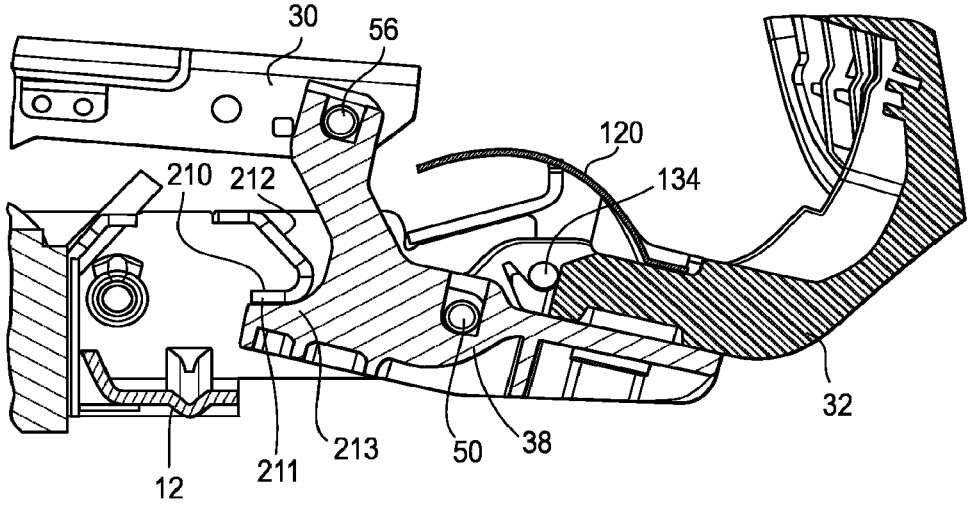
FIG. 38 is a partial side view of the tilt control mechanism with the stop in a disengaged position and the backrest assembly in a full recline tilt limit position.

A stop member 202 includes a linear rack 204 that is translatably and slideably supported by the tilt control housing 12, for example on a linear bearing. The linear rack includes a plurality of upwardly extending teeth 208 spaced apart in the longitudinal direction, with the teeth 208 being intermeshed and engaged with the teeth 196 of the pinion gear. As the pinion gear 192 is rotated in the first and second rotation directions, the pinion gear 192, or teeth 196 thereof, meshes with the teeth 208 and translates the linear rack 204 in first and second translation (e.g., fore and aft) directions. The stop member 202 includes an end portion 209 defined at a rear end of the liner rack, with the end portion having an upwardly facing stop surface 206 and a downwardly facing stop surface 207. The stop surfaces 206, 207 may be defined on other portions of the stop member, including a rear, front, bottom or side surfaces. Referring to FIGS. 35A-C and 36-38, the stop member 202 is translatable, or translatory, in a longitudinal direction to an engaged position (FIG. 35B, 36, 37) when the actuator, or arm 198, is in the first disengaged position. In this engaged position, the stop member 202 engages and prevents at least one of the seat 6 and backrest assembly 8 from moving to the reclined seat and backrest positions respectively when the stop member 202. Specifically, in the engaged position, or predetermined stop position, the stop surface 206 of the stop member is disposed under a first stop surface 210 defined by a bracket 212 coupled to the base support 12, while the second stop surface 207 engages a stop surface 211 on the backrest support 38, thereby preventing the backrest support 38 from rotating or pivoting relative to the base support 12. As shown in FIGS. 35A-C, the stop surfaces 207, 211 may be angled upwardly, or as shown in FIG. 36, the stop surfaces 207, 211 may be horizontal. The stop surface 211 is defined by an arm portion 213 of the backrest support 38, which extends forwardly from the pivot axis 50 such that the arm 213 rotates upwardly or clockwise as the backrest rotates rearwardly and downwardly or clockwise as shown in FIGS. 37 and 38. The stop surface 211 may engage the stop surface 210 when the stop member 202 is in a disengaged position so as to define a full recline tilt limit position of the backrest assembly 8 as shown in FIG. 38. One or more stop surfaces may alternatively be defined by the seat support. As the actuator is further rotated, the pinion gear 192 meshes with and translates the stop member 202 to a first disengaged position (FIG. 35A) when the actuator is in the engaged position. In this first disengaged position, the stop member 202 is disengaged from the at least one of the seat and backrest assembly such that the at least one of the seat and backrest assembly may be moved to the reclined seat and backrest positions respectively. Specifically, the stop surface 206 is positioned in front of the stop surface 210 of the bracket 212 and the stop surface 211 of the backrest support 38, such that the backrest support 38 and seat support 30 may be moved to the reclined position. The actuator may be further rotated in the first rotation direction with the pinion gear 192 meshing with the teeth 208 and translating the stop member to a second disengaged position (FIG. 35C) when the actuator is in the second disengaged position, wherein the stop member 202 is disengaged from the at least one of the seat and backrest such that the at least one of the seat and backrest may be moved to the reclined seat and backrest positions respectively. It should be noted that the first and second disengaged positions are different, meaning the stop member is in a different longitudinal position even though it is disengaged from the bracket 212 and backrest support 38 in both positions. Specifically, the stop surface 206 is positioned in front of the stop surface 210 of the bracket and the stop surface 211 of the backrest support 38, such that at least one of the seat and backrest may be moved to the reclined seat and backrest positions respectively when the stop member is translated, i.e., moved translatory, to the second disengaged position Referring to FIGS. 1-8 and 17-22, the seating arrangement includes an armrest assembly 220. In one embodiment, the armrest assembly is fixedly secured to the base support 12, while in other embodiments, the armrest assembly may be coupled to and moveable with the seat and/or backrest assembly. In one embodiment, the armrest assembly 220 includes a laterally extending strap 222 having opposite end portions 224 and a central or intermediate portion 226. The end portions 224 may be angled upwardly slightly relative to the central portion 226. The strap 222 may have a variety of cross sections, including a rectangular cross section in one embodiment. The strap may be made of an elongated metal bar in one embodiment. The central portion 226 may be secured to the base, seat or backrest with fasteners 228, including various screws, bolts and/or welding, for example. For example, as shown in FIGS. 9-11 and 35A-C, the central portion 226 may be secured to a support platform or bracket 230 defining in part the base support 12. The armrest assembly may also include a tubular member 232, which has a horizontal portion 234 and a vertical portion 236 defining an L-shape in one embodiment. An upper armrest 238, which may include an armrest pad 240, may be telescopically supported on the vertical portion 236, or may be fixed thereto. The tubular member, and horizontal portion 234 has a lower end portion 242 with a first interior opening 244. An adapter 250 includes a first end portion 252 with a second interior opening 254 shaped to receive the end portion 224 of the strap and a second end portion 256, or insert portion, opposite the first end portion shaped to be received in the first interior opening 244 of the tubular member. In one embodiment, the shapes of the end portions 224, 256 and openings 254, 244 are mating, meaning they are the same shape and provide for a sliding interface of the components. The first end portion 224 of the strap also is disposed in the first interior opening 244 of the tubular member. In this way, the end portions 224, 256, 242 of the strap, the adapter and the tubular member are overlapping as shown in FIG. 22. One or more fasteners 260 (shown as two) extend through at least the overlapping portions of the strap, the adapter and the tubular member. For example, the fastener may be configured as a bolt having a head 262 engaging an exterior surface of the tubular member and a shaft extending through the overlapping tubular member, adapter and strap, with the shaft being threadably engaged with a nut 264 engaging an opposite exterior surface of the end portion 242 of the tubular member 232. The adapter 250 may include an interior shoulder 266 or stop surface that is engaged by the second end portion 242 of the tubular member, with the exterior surface 268 of the end of the adapter lying flush with the exterior surface 270 of the tubular member. The end portion 252, or head portion, of the adapter may be tapered from the tubular portion to the end thereof, wherein the strap is received. The insert portion 256 of the adapter extends laterally from the head portion 252 and is received in the tubular member end portion 242 in a close-fit relationship.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A seating arrangement comprising:

a base;

a seat moveably coupled to the base, wherein the seat is moveable between an upright seat position and a reclined seat position;

a backrest moveably coupled to the base, wherein the backrest is moveable between an upright backrest position and a reclined backrest position;

a spring engaged with at least one of the seat or backrest;

a spring actuator rotatable between:

(i) a first disengaged position wherein the actuator is disengaged from the spring;

(ii) an engaged position wherein the actuator engages the spring such that the spring applies a biasing force to the at least one of the seat or backrest as the seat and backrest are moved to the reclined seat and backrest positions respectively; and (iii) a second disengaged position wherein the actuator is disengaged from the spring, wherein the first and second disengaged positions are different; and a stop member moveably coupled to the actuator, wherein the stop member is translatory between:

(i) an engaged position when the actuator is in the first disengaged position, wherein the stop member engages and prevents at least one of the seat and backrest from moving to the reclined seat and backrest positions respectively when the stop member is moved translatory to the engaged position of the stop member;

(ii) a first disengaged position when the actuator is in the engaged position of the actuator, wherein the stop member is disengaged from the at least one of the seat and backrest such that the at least one of the seat and backrest may be moved to the reclined seat and backrest positions respectively when the stop member is moved translatory to the first disengaged position of the stop member; and (iii) a second disengaged position when the actuator is in the second disengaged position of the actuator, wherein the stop member is disengaged from the at least one of the seat and backrest such that the at least one of the seat and backrest may be moved to the reclined seat and backrest positions respectively when the stop member is moved translatory to the second disengaged position of the stop member, wherein the first and second disengaged positions of the stop member are different.

2. The seating arrangement of claim 1 wherein the actuator comprises a pinion gear, and wherein the stop member comprises a linear rack engaged with the pinion gear.

3. The seating arrangement of claim 2 wherein the actuator further comprises an arm extending radially from the pinion gear, wherein the arm comprises an end portion engaged with the spring when the actuator is in the engaged position.

4. The seating arrangement of claim 3 wherein the linear rack comprises a stop surface engaged with the at least one of the seat or backrest when the stop member is in the engaged position.

5. The seating arrangement of claim 4 wherein the spring applies the biasing force to the seat as the seat is moved to the reclined seat position.

6. The seating arrangement of claim 5 wherein the stop member engages and prevents the backrest from moving to the reclined backrest position when the stop member is moved translatory to the engaged position.

7. The seating arrangement of claim 4 wherein the actuator comprises a shaft extending laterally from the pinion gear and a grippable component connected to the shaft and adapted to be gripped by a user.

8. A seating arrangement comprising:

a base;

a seat moveably coupled to the base, wherein the seat is moveable between an upright seat position and a reclined seat position;

a backrest moveably coupled to the base, wherein the backrest is moveable between an upright backrest position and a reclined backrest position;

a spring engaged with at least one of the seat or backrest;

an actuator comprising a pinion gear rotatably coupled to the base about a rotation axis and an arm extend radially from the pinion gear, wherein the pinion gear is rotatable in opposite first and second rotation directions, and wherein the arm engages the spring as the pinion gear is rotated to a predetermined biasing position; and a stop comprising a linear rack moveably engaged with the pinion gear, wherein the linear rack is translatory in opposite first and second translatory directions in response to the rotation of the pinion gear in the opposite first and second rotation directions, and wherein the linear rack comprises a stop surface engaging one of the seat or backrest when the linear rack is moved translatory to a predetermined stop position.

9. The seating arrangement of claim 8 wherein the spring is engaged with the seat.

10. The seating arrangement of claim 9 wherein the stop surface is engaged with the backrest when the linear rack is moved to the predetermined stop position.

11. The seating arrangement of claim 10 wherein the stop surface engages and prevents the backrest from moving to a reclined backrest position when the linear rack is moved translatory to the predetermined stop position.

12. The seating arrangement of claim 9 wherein the spring applies a biasing force to the seat as the seat is moved to the reclined seat position.

13. The seating arrangement of claim 8 wherein the actuator comprises a shaft extending laterally from the pinion gear and a grippable component connected to the shaft and adapted to be gripped by a user.

14. A method of adjusting a seating arrangement comprising:

moving a seat coupled to a base between an upright seat position and a reclined seat position;

moving a backrest coupled to the base between an upright backrest position and a reclined backrest position engaging at least one of the seat or backrest with a spring;

rotating a spring actuator between:

(iv) a first disengaged position wherein the actuator is disengaged from the spring;

(v) an engaged position wherein the actuator engages the spring such that the spring applies a biasing force to the at least one of the seat or backrest as the seat and backrest are moved to the reclined seat and backrest positions respectively; and (vi) a second disengaged position wherein the actuator is disengaged from the spring, wherein the first and second disengaged positions of the actuator are different; and translating a stop member coupled to the actuator between:

(iv) an engaged position when the actuator is in the first disengaged position, wherein the stop member engages and prevents at least one of the seat and backrest from moving to the reclined seat and backrest positions respectively when the stop member is moved translatory to the engaged position of the stop member;

(v) a first disengaged position when the actuator is in the engaged position of the actuator, wherein the stop member is disengaged from the at least one of the seat and backrest such that the at least one of the seat and backrest may be moved to the reclined seat and backrest positions respectively when the stop member is moved translatory to the first disengaged position of the stop member; and (vi) a second disengaged position when the actuator is in the second disengaged position of the actuator, wherein the stop member is disengaged from the at least one of the seat and backrest such that the at least one of the seat and backrest may be moved to the reclined seat and backrest positions respectively when the stop member is moved translatory to the second disengaged position of the stop member, wherein the first and second disengaged positions of the stop member are different.

15. The method of claim 14 wherein the actuator comprises a pinion gear, and wherein the stop member comprises a linear rack engaged with the pinion gear, and wherein translating the stop member comprises rotating the pinion gear and thereby translating the linear rack.

16. The method of claim 15 wherein the actuator further comprises an arm extending radially from the pinion gear, and wherein rotating the pinion gear comprises rotating the arm and engaging the spring with the arm when the actuator is in the engaged position.

17. The method of claim 15 wherein the actuator comprises a shaft extending laterally from the pinion gear and a grippable component connected to the shaft, and wherein rotating the pinion gear comprises rotating the grippable component.

18. The method of claim 14 further comprising applying the biasing force to the seat as the seat is moved to the reclined seat position.

* * * * *